US009290300B2

(12) United States Patent
Hendrickson et al.

(10) Patent No.: US 9,290,300 B2
(45) Date of Patent: Mar. 22, 2016

(54) MODULAR INTERLOCKING CONTAINERS

(75) Inventors: B. Everett Hendrickson, Los Angeles, CA (US); Timothy J. Carlson, Arlington, VA (US); A. Irene Hendrickson, Los Angeles, CA (US)

(73) Assignee: Friendship Products LLC, Los Angeles, CA (US)

( * ) Notice: Subject to any disclaimer, the term of this patent is extended or adjusted under 35 U.S.C. 154(b) by 0 days.

(21) Appl. No.: 13/385,439

(22) Filed: Feb. 21, 2012

(65) Prior Publication Data

US 2013/0213927 A1 Aug. 22, 2013

(51) Int. Cl.

| | |
|---|---|
| ***B65D 21/028*** | (2006.01) |
| ***B65D 23/00*** | (2006.01) |
| ***B65D 21/02*** | (2006.01) |
| ***B65D 81/36*** | (2006.01) |
| ***E04H 1/00*** | (2006.01) |
| ***E04H 7/22*** | (2006.01) |

(52) U.S. Cl.

CPC ..... *B65D 23/00* (2013.01); *B65D 21/0204* (2013.01); *B65D 21/0231* (2013.01); *B65D 81/361* (2013.01); *E04H 1/005* (2013.01); *E04H 7/22* (2013.01)

(58) Field of Classification Search

CPC .... B65D 69/00; B65D 88/027; B65D 81/361; B65D 21/0216; E04B 2/08

USPC ..... 206/510, 509; 220/23.6, 23.4, 771, 781, 220/380; 215/10, 383, 382

See application file for complete search history.

(56) References Cited

U.S. PATENT DOCUMENTS

| | | | | |
|---|---|---|---|---|
| 2,753,077 | A | | 10/1952 | Greco |
| 2,641,374 | A | * | 6/1953 | Der Yuen ..... 215/10 |
| 3,194,426 | A | | 7/1965 | Brown |
| 3,307,729 | A | | 3/1967 | Schwartz |
| 3,369,658 | A | | 2/1968 | Hasselmann |
| 3,391,824 | A | | 7/1968 | Wiseman |
| 3,815,281 | A | | 6/1974 | Kander |
| 3,944,074 | A | | 3/1976 | Riley |
| 3,994,408 | A | | 11/1976 | Belitzky |
| 4,003,491 | A | | 1/1977 | Wells et al. |
| D249,232 | S | * | 9/1978 | Van der Veken ..... D9/640 |
| 4,258,847 | A | | 3/1981 | Nierman |
| 4,308,955 | A | | 1/1982 | Schieser |
| 4,363,415 | A | | 12/1982 | Rainville |
| 4,515,842 | A | | 5/1985 | Kovacs |
| 4,521,178 | A | | 6/1985 | Anger |
| 4,624,383 | A | | 11/1986 | Moore |
| 4,685,565 | A | | 8/1987 | Sparling |
| 4,889,254 | A | | 12/1989 | Vola |
| 4,966,298 | A | | 10/1990 | Von Holdt |
| 5,050,755 | A | | 9/1991 | Strawder |
| 5,124,110 | A | | 6/1992 | Yokobayashi |

(Continued)

*Primary Examiner* — Mickey Yu
*Assistant Examiner* — Allan Stevens
(74) *Attorney, Agent, or Firm* — Kendal M. Sheets

(57) ABSTRACT

The invention includes a scalable, modular interlocking container with a multi-purpose use. Vertical and horizontal interconnectivity are achieved through interlocking mechanisms. An exemplary first use is for transporting and/or storing liquids or solids that can be poured. An exemplary second use is for a sturdy, low cost, easily assembled building block material of a standardized nature. Each modular unit slide-locks with other units to form strong wall and building structures that can be filled with natural earth, sand or other such materials, thereby forming a sturdy structure without the use of mortar, and can adapt to uneven base surfaces typically found in natural terrain.

13 Claims, 40 Drawing Sheets

(56) References Cited

U.S. PATENT DOCUMENTS

| | | | | |
|---|---|---|---|---|
| 5,135,823 | A | 8/1992 | Eales | |
| D341,781 | S | 11/1993 | Sanyal | |
| 5,271,515 | A | 12/1993 | Berkheimer et al. | |
| 5,290,506 | A | 3/1994 | Yokobayashi | |
| 5,310,071 | A | 5/1994 | Rivlin et al. | |
| 5,316,159 | A | 5/1994 | Douglas et al. | |
| 5,340,304 | A | 8/1994 | Nakamura | |
| 5,381,916 | A | 1/1995 | Strawder | |
| 5,503,288 | A * | 4/1996 | Conconi | 220/4.21 |
| 5,638,974 | A | 6/1997 | Mann | |
| 5,766,536 | A | 6/1998 | Felder | |
| 5,779,051 | A * | 7/1998 | Boutin | 206/504 |
| D407,020 | S | 3/1999 | Doty | |
| 6,045,746 | A | 4/2000 | Komine et al. | |
| D437,366 | S | 2/2001 | Stemmler | |
| D439,156 | S | 3/2001 | Hall et al. | |
| 6,276,549 | B1 * | 8/2001 | Fasci et al. | 220/23.4 |
| D464,887 | S | 10/2002 | Sherwell | |
| 6,719,161 | B1 | 4/2004 | Craig | |
| 6,872,354 | B1 | 3/2005 | Mol et al. | |
| 6,875,396 | B1 | 4/2005 | Limanjaya | |
| 7,175,498 | B2 * | 2/2007 | Garpow et al. | 446/117 |
| 7,614,515 | B2 | 11/2009 | Furusawa et al. | |
| 7,887,315 | B2 | 2/2011 | Lane | |
| 7,939,005 | B2 | 5/2011 | Balboni et al. | |
| 7,967,162 | B2 | 6/2011 | Pallo et al. | |
| 8,201,699 | B2 | 6/2012 | Zummo et al. | |
| 8,226,402 | B2 | 7/2012 | Rousseau | |
| 8,348,658 | B2 | 1/2013 | Dagorn | |
| 2004/0202746 | A1 | 10/2004 | Tsau | |
| 2005/0011853 | A1 | 1/2005 | Brugger | |
| 2006/0059838 | A1 | 3/2006 | Pimental | |
| 2007/0098935 | A1 | 5/2007 | Farran et al. | |
| 2009/0045157 | A1 * | 2/2009 | Panchal et al. | 215/10 |
| 2009/0266782 | A1 * | 10/2009 | Lane | 215/10 |
| 2010/0203186 | A1 | 8/2010 | Tsau | |
| 2012/0118848 | A1 * | 5/2012 | Hendrickson et al. | 215/40 |

* cited by examiner

MODULAR INTERLOCKING CONTAINERS

BACKGROUND

Recently, world events and natural disasters have caused more attention to be given to the intermixing of environmental, economic, and humanitarian needs around the world. For example, the Pacific Ocean tsunami, earthquakes in Haiti and Peru, and Hurricane Katrina all caused immense humanitarian needs and devastating loss of life. First responders to such disasters normally set up tents to house refugees. The assumption is that the stay in the tents will be brief. However, depending on the disaster, the results often show otherwise. Tents are only useful in limited climate conditions. They also wear out over time, forcing residents to piece together sticks, branches, scrap metal or plastic for tent repair. The relatively few plastic containers in disaster relief sites are used mainly for water vessels, even though many are discarded fuel containers.

One example of such a scenario is the Abu Shouk IDP camp in El Fasher, Northern Darfur. There, refugees were placed in tents on a vast scale numbering in the thousands, where they denuded the vegetation during their difficult and lengthy duration of stay. These lengthy stays under conditions of severe deprivation tax the host nation's natural resources and increases the environmental degradation of the host landscapes via stripped vegetation and toxic garbage dumps. These environmental burdens naturally lead to political pressure on the host government to insist on shorter stays. In war torn areas, shifts in zones of control may force camp dwellers to flee approaching combatants, even in the absence of "official" pressure.

Other environmental and economic issues develop more slowly, such as the issue of widespread and burgeoning use of plastic beverage bottles and the enormous amount of waste caused by their disposal. One estimate states that Americans consume 2.5 million plastic bottles every five minutes, or about 263 billion bottles each year. Approximately one-quarter of all plastic bottles are made with PET plastic for drinking water or soft beverages.

Although some consumers recycle, mountains of bottles still go to waste. Over the past decade recycling rates in America have decreased from over 30% to just over 20%, meaning close to 80% of plastic bottles end up in the waste stream. Approximately 50 billion PET bottles alone are wasted each year. Much of that waste ends up in landfills, but a significant amount ends up in roadside dumps or, even worse, in rivers and oceans. The "Pacific Trash Vortex," is also known as the "Great Pacific Garbage Patch." It is steered by prevailing currents to a still zone north of Hawaii. The Vortex has four to six million tons of a soup-like garbage mix that hovers just under the surface in an area the size of Texas or France. It is estimated that 80% of the Vortex is from plastic, with a large portion being PET plastic bottles.

Due to expanding populations increasing the demand for drinking water, food, and consumables, including in disaster zones, the need for plastic bottles will only increase.

There is, then, a compelling need for plastic bottle designs that have secondary uses such that consumers will contemplate a fuller life cycle for the bottles. Such uses could increase recycling rates, or re-use rates, thereby lowering the volume of waste bottles disposed of each year and in the decades ahead.

SUMMARY OF THE INVENTION

Various embodiments of scalable, modular, interlocking containers provide a first use as a vessel for transporting and/or storing liquid, granular or other small regularly shaped materials relatively easy to empty via pouring. An additional exemplary use is as a sturdy, modular, low cost, easily assembled building material of a standardized nature. Examples of uses as building materials are to construct basic structures and shelter applications in international relief and development efforts, and/or structures and shelter for military applications. A further use is attendant to the disassembly of structures (walled and otherwise) built from the containers, such as disassembly for purposes of relocating and/or reconfiguring the units as needs change. Embodiments of reduced sized have other uses, such as for a modeling agent or modeling toy.

All uses also greatly benefit the environment by reducing the waste stream through recycling. The U.S. Environmental Protection Agency reported that from 1980 to 2005, the volume of municipal solid waste increased 60% resulting in 246 million tons being generated in 2005 in the United States. The present invention provides an incentive to recycle containers not only for similar uses (such as to hold materials) but also for building blocks for shelter construction and other applications. For example, certain embodiments of containers and bottles containing solid and liquid foodstuffs are recycled into use as construction materials, thereby reducing solid waste. Other recycled uses even include amusement toys for children and/or modeling elements for children and adults. The embodiments of consumer-sized containers could also increase the potential for recycling into other uses, which could reduce the two million tons of trash in the United States that is generated from throwing away plastic water bottles. Containers made of aluminum or other packaging materials account for another very large portion of the trash stream. The incentive for consumers to "mass" containers after their original use makes it considerably more likely that the containers will be recycled in similar high proportion once their secondary use has terminated, a pattern that promises to improve end-stage recycling rates markedly. The embodiments also have humanitarian purposes. Resulting simple walled structures are easily amenable to local/traditional roofing solutions or to emergency relief roofing techniques and materials. Exemplary containers allow cost-effective molding by eliminating unnecessary details in the search for elegance.

Because the design of the containers of the embodiments are scalable to provide different volumetric capacities, the resulting containers can be used in various sizes from large applications (e.g., ten liters or more) to much smaller version (e.g., 500 mL), with many ranges in between. Larger scaled versions are ideal for the tremendous volumes of goods shipped world-wide to disaster relief and areas of displaced persons or development efforts where the lack of inexpensive, easily-assembled building material is particularly pressing. Once a consumer has exhausted the first use of the design as a product container, the remaining empty vessel can be filled with any of several virtually costless materials—water, dirt, or sand, for example, to create sturdy building blocks, and at times even air via a special pump, for a wide variety of basic but very useful structures: family housing, dispensaries (clinics, stores, etc.), barracks, animal shelters, storage facilities, retaining walls, other strong structures. Some of the uses are generalizable to needs in the most developed nations as well. In whatever setting, the particular physical features of the invention allow efficiency in packing, shipping, and handling.

Smaller-scale containers of the embodiments for consumer beverages and the like allow the consumer to use the containers as creative architectural modeling, since the units interconnect solidly even when left empty. In the latter respect, use as a type of architectural "toy" can be implemented by a broad age span of users.

Finding efficient transportation of bulk quantities of containers for any purpose can be challenging. With the present invention, efficient packing and transport of containers are helped by avoidance of odd shapes and without damage caused by unnecessary protruding edges. Units are scalable to conform to shipping norms, including sizes of pallets and containers.

Perfect scalability of containers offer sizes and volumes regularly used in relevant industries, including prominently in the international delivery of relief and development field, but also for other practical and/or hobbyist uses. Embodiments are also reusable containers in all geographic regions, including in sizes amenable to beverages and other consumer goods. They have ease of assembly by strength-challenged disaster victims and/or by persons without building experience. No mortar, rebar or any other connective additions is needed, and despite no mortar or reinforcing elements, resulting structures should withstand stress forces such as high winds and earthquakes.

All uses of the present invention result in significant reductions of container material direct to the waste streams and dumping areas. Moreover, all versions are ultimately recyclable, such that the design yields an entire lifecycle of uses as an efficient container for the initial delivery of goods, as a sturdy, highly adaptable, durable, and inexpensive construction material and/or component for architectural designs, and as an eventual standard material for recycling. The introduction of a container as both useful to hold goods and perform as a construction base represents at least a 50% increase in product functionality in an era where full and well-directed use of resources is ever more critical. When combined with the aforementioned efficiencies in shipping, this multi-cycle employment attains some of the highest goals for the design of responsible products.

FIGURES

The accompanying figures, where like reference numerals refer to identical or functionally similar elements throughout the separate views and which together with the detailed description below are incorporated in and form part of the specification, serve to further illustrate various embodiments and to explain various principles and advantages:

DETAILED DESCRIPTION OF THE INVENTION

Figure 1:
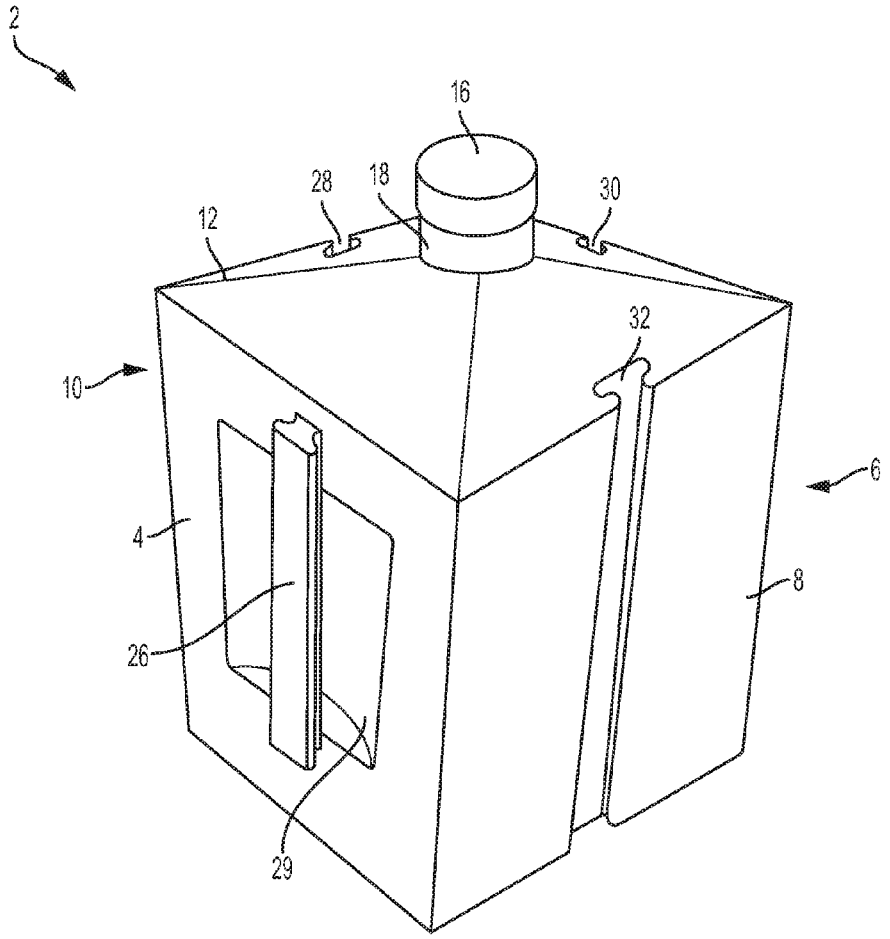
FIG. 1 is a modular interlocking container of a cuboid design of the embodiments.
Figure 2:
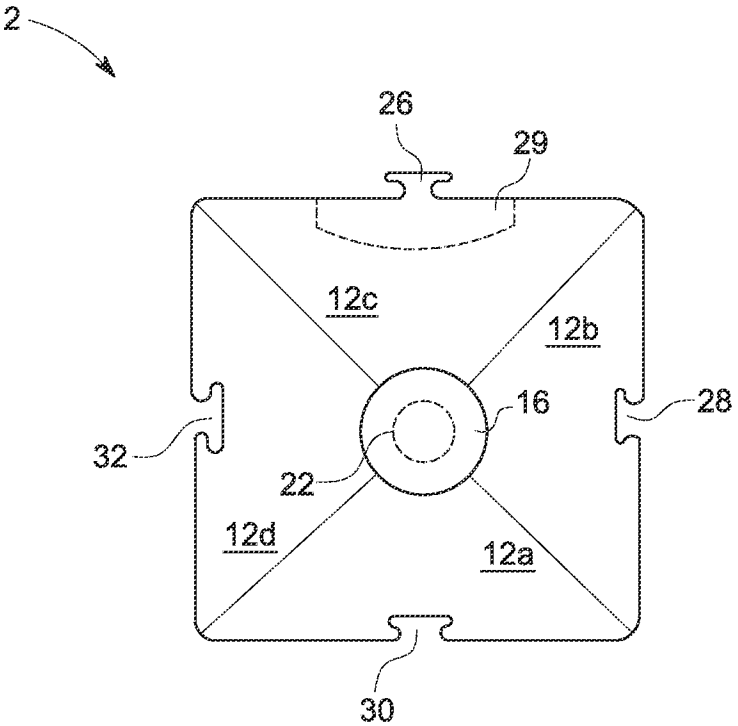
FIG. 2 is a plan view of the container of FIG. 1.

Before describing embodiments in detail, it should be observed that the embodiments reside largely in combinations of method steps and apparatus components related to method and system for determining benefits of scalable, modular, interlocking containers with follow-on utility.

Accordingly, the apparatus components and method steps have been represented where appropriate by conventional symbols in the drawings, showing only those specific details that are pertinent to understanding the embodiments so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

The embodiments of the invention include a scalable, modular interlocking container with a multi-purpose use. An exemplary first use is for transporting and/or storing liquids or solids that can be poured. An exemplary second use is for a sturdy, low cost, easily assembled building block material of a standardized nature. The embodiments can be used for building housing or storage structures for disaster relief, humanitarian development projects, for military or defense purposes, and for modeling purposes. The embodiments include a single unit that is interlocked to other modular units of the same or different sizes. Each modular unit slide-locks with other units to form strong wall and building structures that can be filled with natural earth, sand or other such materials, thereby forming a sturdy structure without the use of mortar, and can adapt to uneven base surfaces typically found in natural terrain.

Embodiments of a scalable, modular container are illustrated in FIGS. 1, 2, 3, and 4. Referring to FIG. 1, an exemplary embodiment of discrete modular container 2 is illustrated. Container 2 is a hollow block element that may be constructed of plastic, metal, resin, or other appropriate high-strength materials to provide stackable rigidity. Top end section 12 and bottom end section 14 form a square or rectangular footprint as end pieces that frame upright, opposing walls 4 and 6 and upright opposing walls 8 and 10. One skilled in the art will recognize that the shape of the container 2 could be a design construction of a polygon of greater than four opposing side walls.

Top end 12 provides for filling container 2 through an opening 22 formed by neck 18 with a fluid or solid material that can be poured. A cap 16, may be screw-on using threads, snap on, or any type of seal that could form a seal to hold contents. When sealed with cap 16, container 2 should be water-tight such that it is amenable for use in transporting liquids (e.g., water or cooking oil), granulated or powdered goods (e.g., grains, seeds, flour), household materials (e.g., soap, cleaners), or construction materials (e.g., cement, sand). Top end 12 is formed with a pyramidal rise from each squared top-edge of upright walls 4, 6, 8, 10 to converge at neck 18 at the apex. Such a pyramidal shape provides for smoother exit pouring and allows for complete refilling of container 2 where desired. Triangular top sections 12*a*, 12*b*, 12*c*, and 12*d* of top end 12 rise from side walls to neck 18 and provide additional resistive strength to a weight of an additional container that may be stacked on top of container 2.

Figure 3:
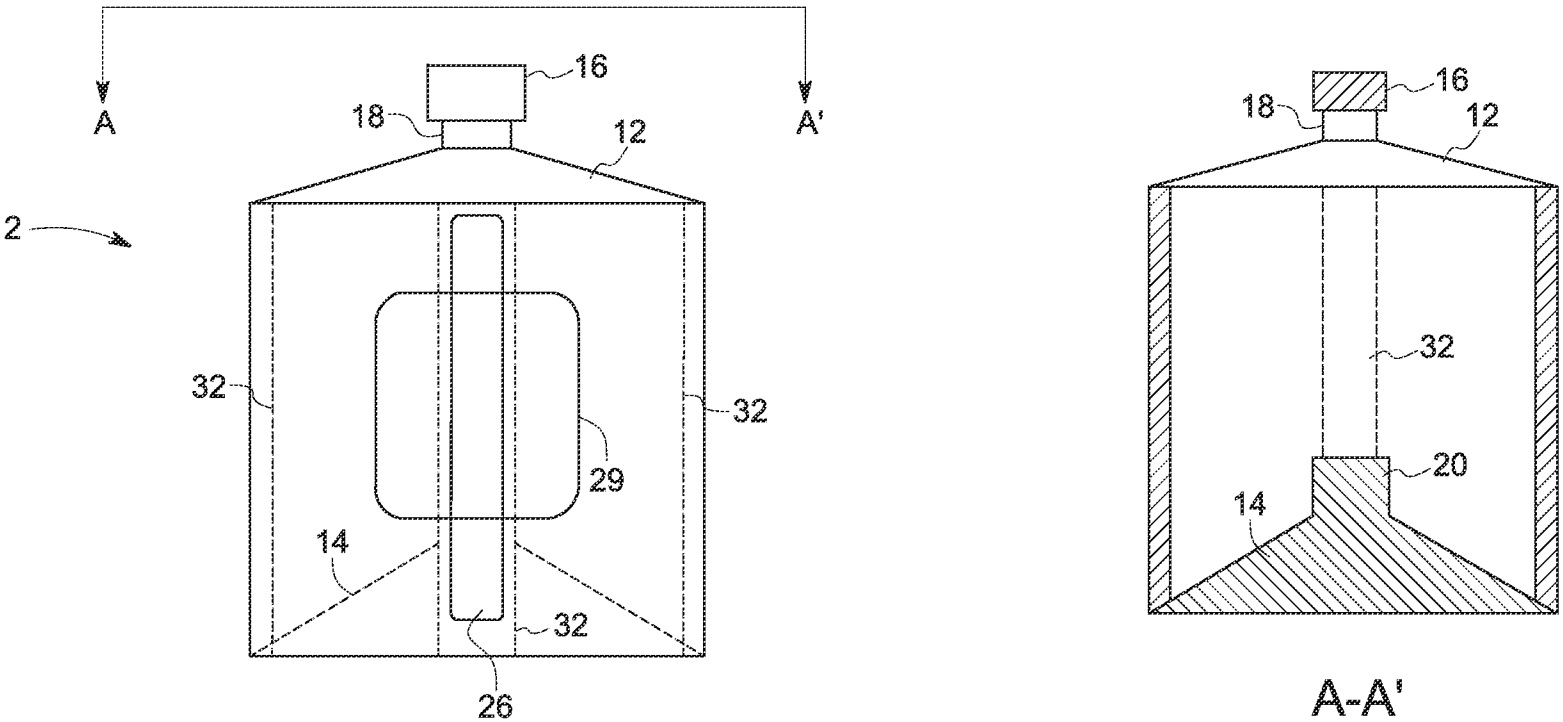
FIG. 3 is a side view of a handle-bearing side of the container of FIG. 1.
Figure 4:
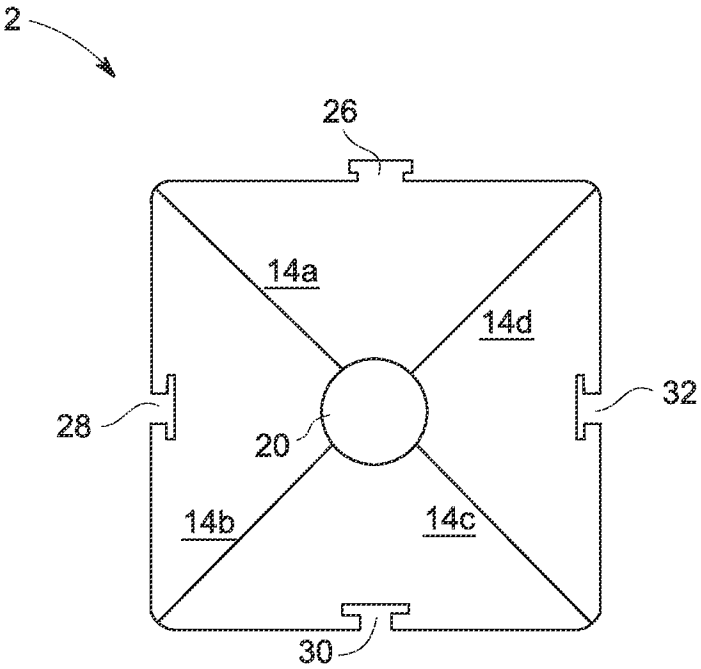
FIG. 4 is a bottom view of the container of FIG. 1.

Bottom end 14 is shaped in a pyramidal form similar to top end 12. As shown in FIGS. 3, 4, bottom end 14 comprises triangular bottom sections 14*a*, 14*b*, 14*c*, and 14*d* that rise from each bottom edge of walls 4-8, respectively, to converge at cylindrical indention 20. Indention 20 is sized to receive a cap from a similar container to 2 that has a similar cap to 16. Likewise, bottom end ridges 14*a*-14*d* would rest against top end ridges from a similar container having ridges formed as ridges 12*a*-12*d*.

For assembly into walls and other structures, a dimension of container 2 of approximately a 3:2 height to width ratio lowers the center of gravity of each modular container, thereby creating or increasing stability for stacking and shipping. However, the invention is not limited to this ratio, and one skilled in the art will recognize that other embodiments will demonstrate that other ratios are useful and possible.

Figure 5:
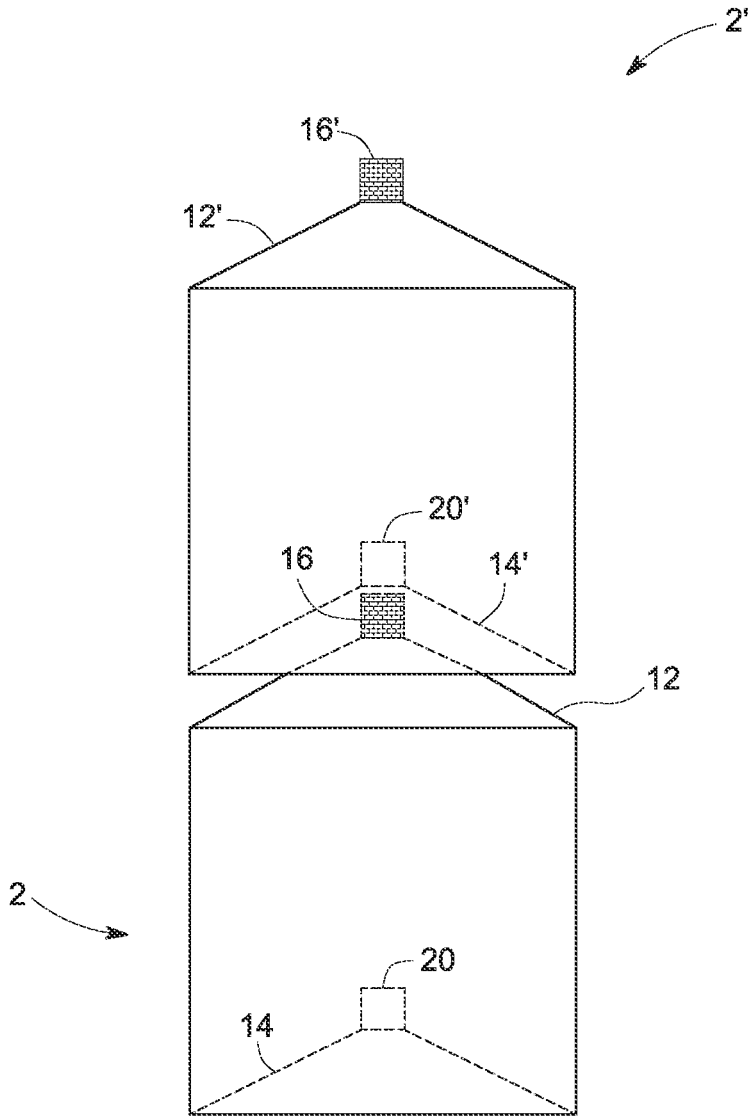
FIG. 5 illustrates vertical interconnectivity of multiple containers of FIG. 1.

A stacked arrangement of containers is illustrated in FIG. 5. Containers 2 and container 2', which are similar in all respects, are arranged to illustrate how the two containers would connect vertically. Container 2' has a top end with pyramidal rise 12', a bottom end with indented pyramidal rise 14', and an indention 20' at its apex that is sized to receive top end pyramidal rise 12. When arranged in a stacked configuration, bottom end pyramidal rise 14' and indention 20' receive top end pyramidal rise 12 and cap 16. Containers 2 and 2' are secured together by the weight of container 2' and its contents (if any) upon container 2, and also by a reasonably snug fit of the inserted cap. Containers 2 and 2' also have some horizontal interconnectivity when cap 16 is received by indention 20'.

Figure 6:
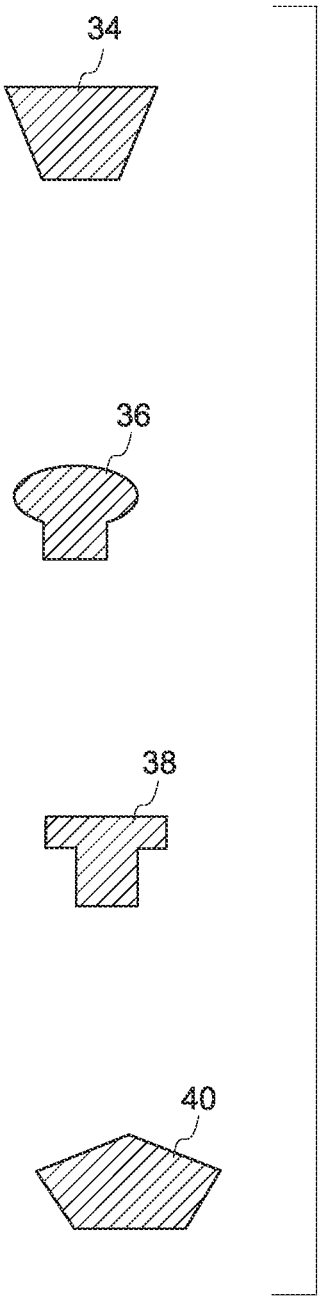
FIG. 6 illustrates interconnection extensions of the embodiments.

Container 2 provides a mechanism to connect with another container in an interlocking manner using handle 26 and corresponding recessions 28, 30, and 32. Handle 26 is integrated into side 4 in a perpendicular orientation to bottom end 4. Handle 26 may extend a partial or full length of side 4. Indention 29 is disposed as an indent into wall 4 with adequate concave space 29 to provide clearance for a person's hand to grip handle 26. Concave space 29 is disposed opposite a central portion of handle 26, thus allowing handle 26 to maintain the lowest practical profile, also thereby minimizing the depth of corresponding recessed grooves 28, 30, and 32 into which handle 26 interlocks. Recessed grooves 28, 30 and 32 are located along each individual wall 10, 6 and 8, respectively, and are formed to receive a handle similar in shape and size to handle 26. FIG. 6 shows some illustrative cross-sectional designs possible for handle 26. Handle 34 is a trapezoidal shape flaring away from wall 4. Recessed groove embodiments include trapezoidal shape 28 or the recessed groove equivalents of 34, 36, 38 and 40 and any similar shapes allowing slide locks.

Figure 7A:
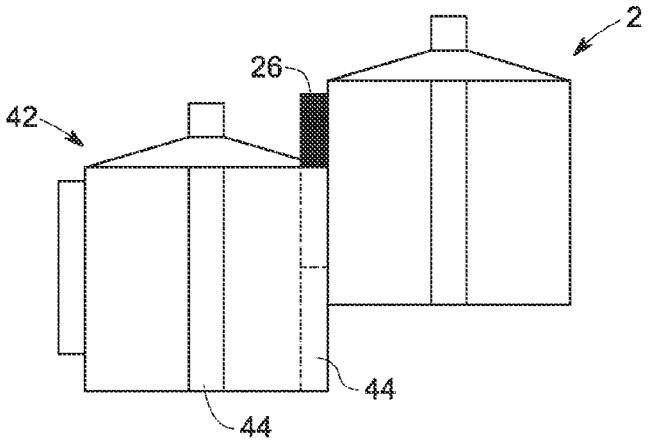
FIGS. 7A and 7B illustrate interconnectivity of multiple containers of the embodiments.
Figure 7B:
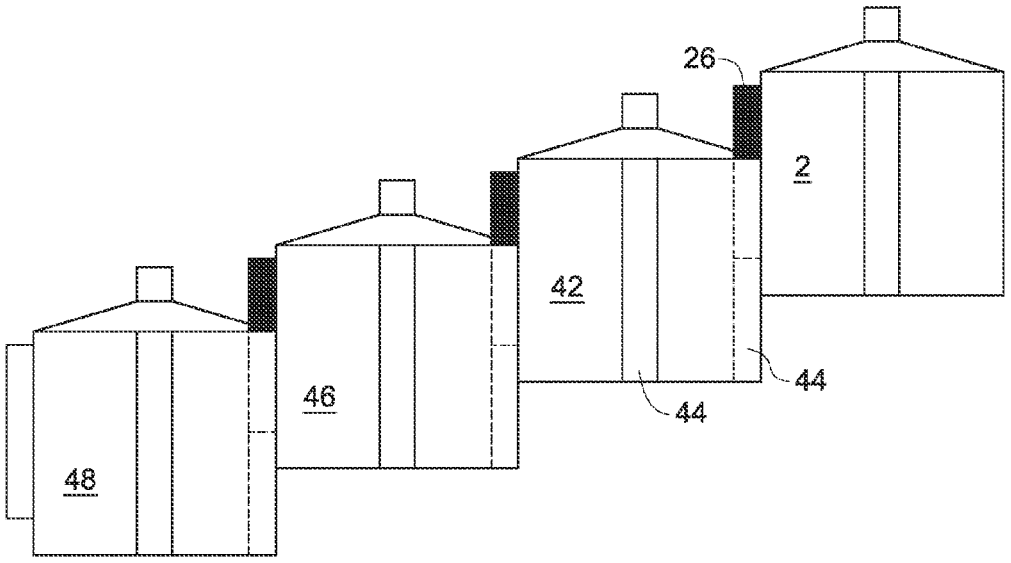
Figure 8:
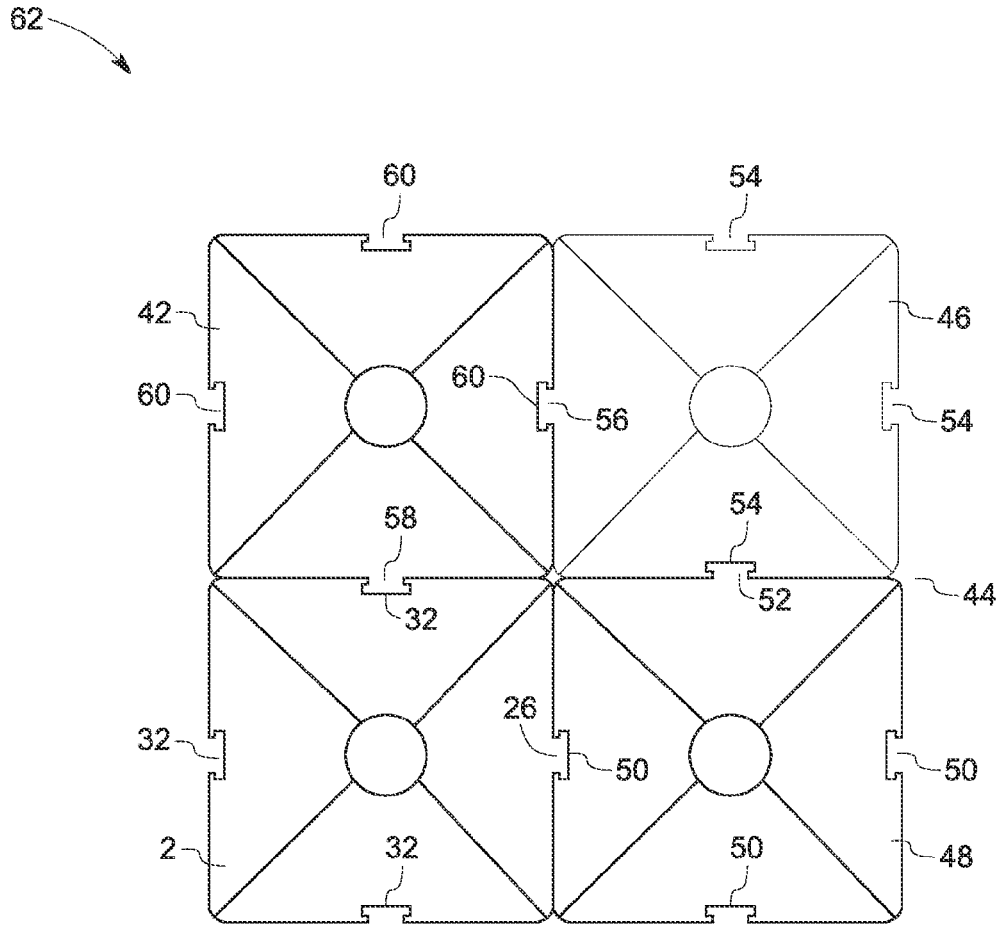
FIG. 8 illustrate interconnectivity of multiple containers of the embodiments.

Referring to FIG. 7A, containers 2 and similarly-constructed container 42 are illustrated interlocked, where handle 26 is slidably inserted into recessed groove 44. FIG. 7B illustrates a series of four containers 2, 42, 46, and 48 partially interlocked horizontally using the handle-in-groove method of slidable connections. To illustrate interconnectivity in a square unit configuration, FIG. 8 shows containers 2, 42, 46 and 48 interlocking where each block's handle is slidably inserted into a recessed groove of each adjoining block at a right angle. For example, container 2 has handle 26 with three recessed grooves 32, container 42 comprises handle 58 and three recessed grooves 60, container 46 comprises handle 56 and three recessed grooves 54, and container 48 comprises handle 52 and three recessed grooves 50. When assembled, handle 26 inserts into groove 50, handle 52 inserts into groove 54, handle 56 inserts into groove 60, and handle 58 inserts into groove 32, thereby forming a squared unit 62 of four containers. Due to the 3:1 ratio of grooves-to-handles, there are no protruding parts on the perimeter of the assembled unit of containers. This 3:1 configuration allows a cubed design of containers to maximize the number of lateral connections that can interlock with additional containers from any of the three grooved sides. Using a handle/recessed groove in a configuration of one handle with three grooves to a container also allows a construction of multiple containers to have relatively flat faces on corners and walls when constructed with multiple containers.

Figure 9A:
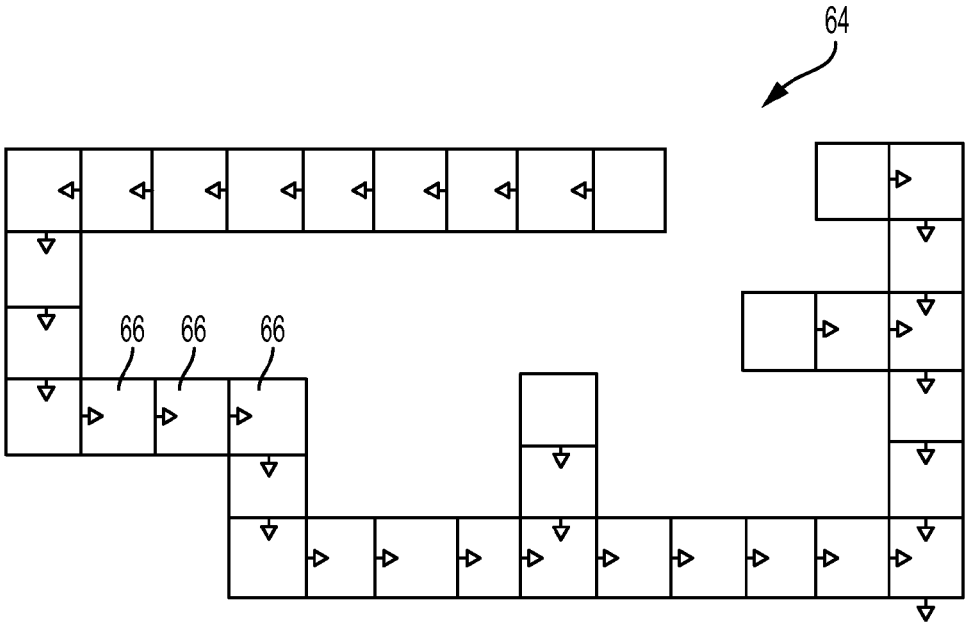
FIGS. 9A and 9B illustrate a plan view of structures constructed from the containers of the embodiments.
Figure 9B:
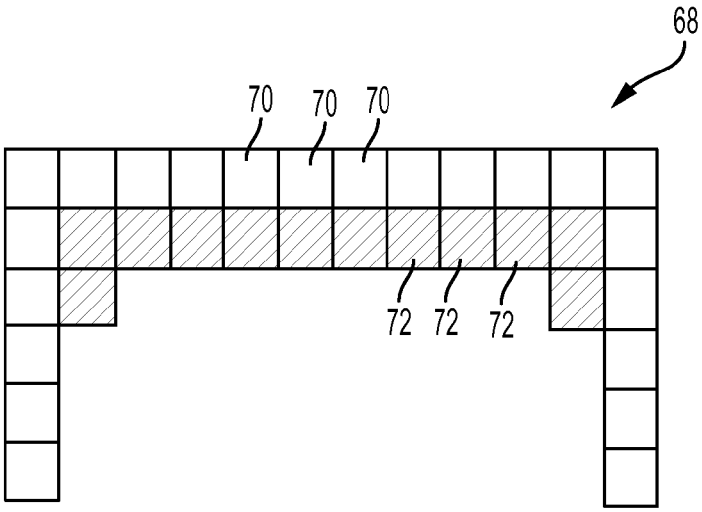

FIGS. 9A and 9B illustrate plan views of structures that are possible to build with the modular container 2 of the embodiments. The embodiments of the present invention, supporting one connection point and three recessed grooves in a square footprint, allows diversions of walls in any direction with the same thickness in each wall. The containers allow simple construction of the walls and ease of construction in aligning right angle corners without the use of tools. Structure 64 in FIG. 9A illustrates multiple exemplary containers aligned in a single file to form walls. Arrows drawn in exemplary containers 66 represent the direction of each handle 26 from a container 2 that is inserted into an adjacent container's recessed groove 28, 30, or 32. Turns are all constrained as a right angle. Structure 68 illustrates a wall constructed with exemplary modular containers 72 that is interlocked onto a second wall 70. Experimentation with several layouts and orientations of other connector-to-receiver rations revealed that a 1-to-3 ratio of connector to receivers maximized the number of lateral connections and add-ons from any direction, including prominently those made after the construction of the original structure. The orientation of handle 26 inserting into a recessed groove of an adjacent container allows constructors to turn 90° corners neatly and securely, without protrusions extending along the faces of the walls, and without the aid of instruments.

The following comments regard the types of real-world challenges likely encountered in emergency relief camps and other development settings. One such reality is that the ground is rarely perfectly even and flat; bare ground surfaces are often slightly sloped and many times erose. Another reality is that any underlying disastrous conditions may leave many end-users physically, mentally, and psychologically taxed. It is also likely that not all necessary building materials will be available at once. The nature of distribution in disaster relief or development venues is such that the flow of available containers might prove unsteady in certain periods. These needs were taken into account for the features of variable sequencing in manner of construction for the embodiments. This means that the assembly of structures whether for storage, protection or housing should not be constrained to some exact order, but rather should accommodate fits and starts, changes of layout, and even planning mistakes. Exploring solutions to these issues results in embodiments of durable and workable connectors for top-to-bottom and side-to-side interlocks in a manner conducive to complete modularity. Compressive strength for vertical construction and tensile strength for horizontal strength and flexibility are introduced in order to withstand harsh weather such as high winds and most earthquakes, and provide insulation against cold temperatures. The handle and corresponding recession(s) provide positive interlocking through the means of sliding handles downward into recessed vertical slots along container side walls. The long vertical folds considerably increase stress resistance on outer walls, an important factor where a major anticipated use for the embodiments is for walls made of stacking containers refilled fully or partially with sand, dirt or other heavy substances. By using the handle as an interlocking device other means of side-to-side linkage can be eliminated, thereby streamlining the manufacturing design and process.

The sliding assembly arrangement meets other essential criteria for the design: (1) avoidance of the need for mortar or other connecting material foreign to the modular container itself, and (2) assembly and disassembly easy and straightforward enough for users with little or no construction experience.

Figure 10A:
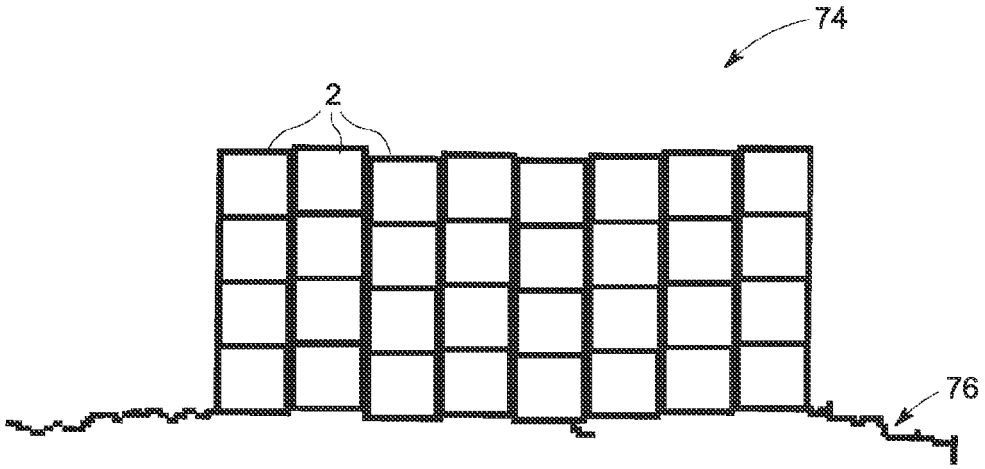
FIGS. 10A and 10B illustrate a side view of structures constructed using containers of the embodiments.
Figure 10B:
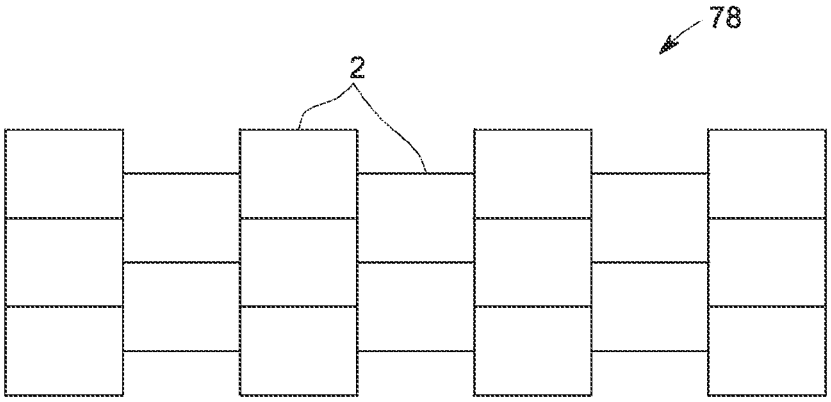

Referring therefore to FIG. 10A, a wall structure 74 is constructed with exemplary containers 2 that are stacked (in this example) in columns four-high vertically and connected side-to-side in four rows across. Ground surface grade 76 is uneven. Because the handle-groove side connections of the embodiments for an interlocking modular container and building block provide for unrestricted vertical sliding, the base or ground surface 76 of a modular wall construction does not need to be absolutely level before erecting a solid and functional structure. The mix of sturdy modular containers 2 and flexibility in vertical and horizontal alignment is amenable not only to constructing enclosures on inclines but also to withstand inclement weather and to withstand earthquakes. In an alternative embodiment, the flexible horizontal and vertical functionality allows the builder to also stagger the rise of the modular containers 2 where desired. Wall 78 in FIG. 10B illustrates multiple containers of the embodiments constructed in a horizontally staggered design. This method of building provides even greater strength to a wall than an evenly stacked embodiment. To provide for ease of construction of this alternative staggered design 78, shallow notch marks may be placed at halfway locations (and/or other locations) on each vertical wall of a container allows builders to line up containers without instruments.

Figure 11:
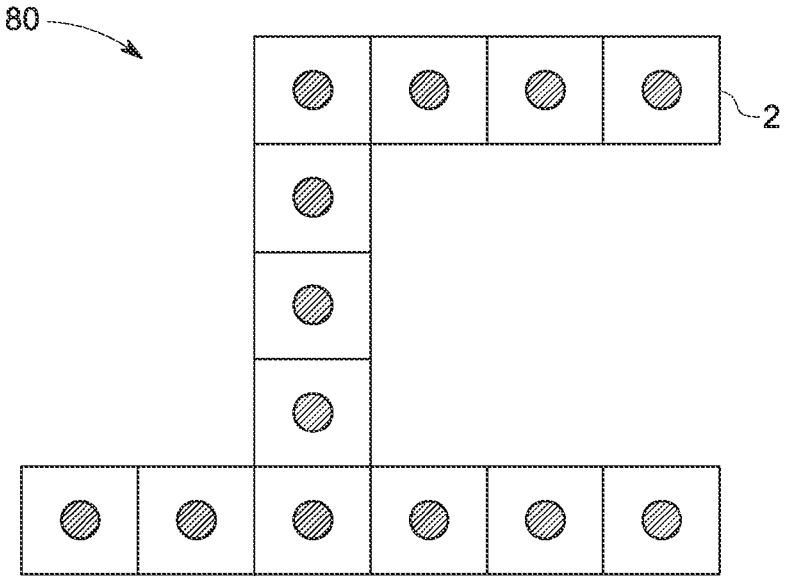
FIG. 11 illustrates a wall structure constructed using containers of the embodiments.
Figure 11:
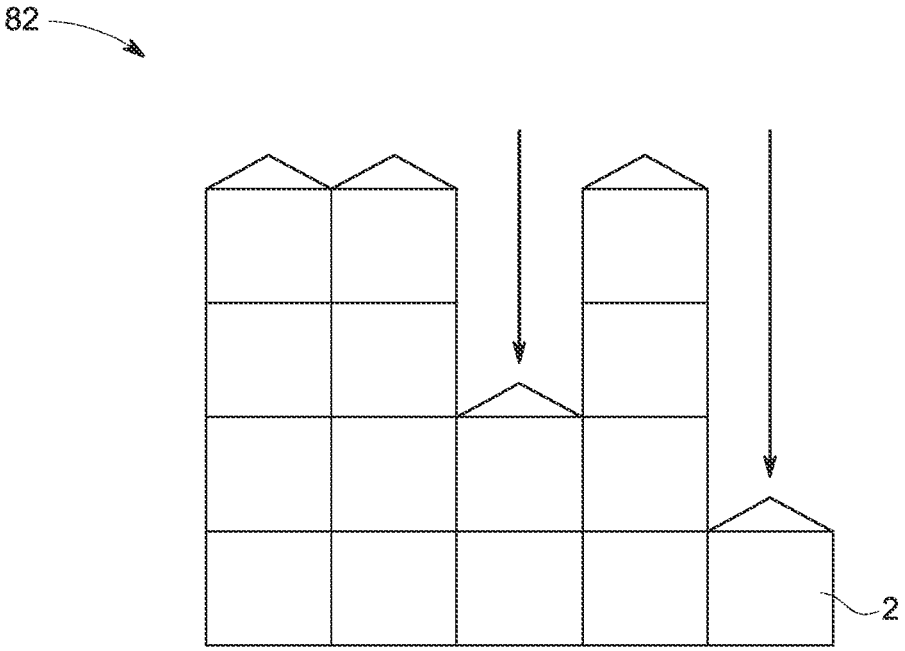

Referring to FIG. 11, various walls constructed with exemplary containers 2 comprising a 1-handle and 3-recessed groove design are shown. Corners and ninety degree turns in wall 80 (in plan view) can be accomplished without causing protrusions out to either side of the wall faces. To illustrate the easy and flexible modularity and connectivity in vertical stacking, wall 82 comprises two columns of four stacked containers, one column of two stacked exemplary containers and one column being a single container. Such design functionality using the embodiments provides for diversions of and changes to walls in virtually any direction with the same or similar thickness of walls and makes it very easy to align right angle corners without any tools. The resulting structures square up almost automatically.

Further, replacement of portions of vertical wall 82 can be accomplish by sliding one or more containers comprising vertical, or vertical and horizontal, interlocking container units laterally upwards and out of the wall 82 without disturbing any of the other remaining portions of the wall. This is a feature of the embodiments that creates modularity of units or groups of containers instead of individual containers only. The embodiments allow easy reworking of constructed structures and a greater flexibility of assembly. In addition to construction, there is a greater ease of disassembly in the face of mistakes or for purposes of reconfiguration or re-transport as conditions shift.

In other embodiments, individual containers that are in rows stacked higher to the top of a wall could remain partially or wholly empty of solids or fluids. This approach would have the advantages of placing considerably less weight pressing down on units of containers placed in lower rows of a wall, and it would permit better daytime interior visibility within an enclosed structure in a case where exemplary containers are manufactured from translucent material. Because the various ridges and groves lend considerable strength even to containers kept empty, alternatively any number of containers comprising the given structure can be filled with lower density materials such as paper, cloth scraps, leaves, grass and the like to provide good insulation without significant additional weight.

Figure 12A:
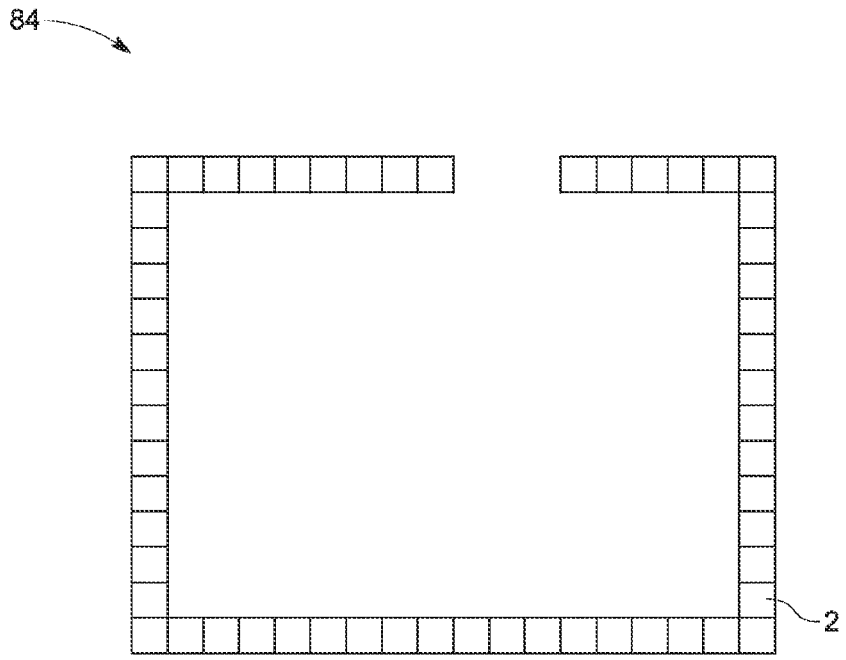
FIGS. 12A and 12B illustrate a shelter and roof constructed using containers of the embodiments.
Figure 12B:
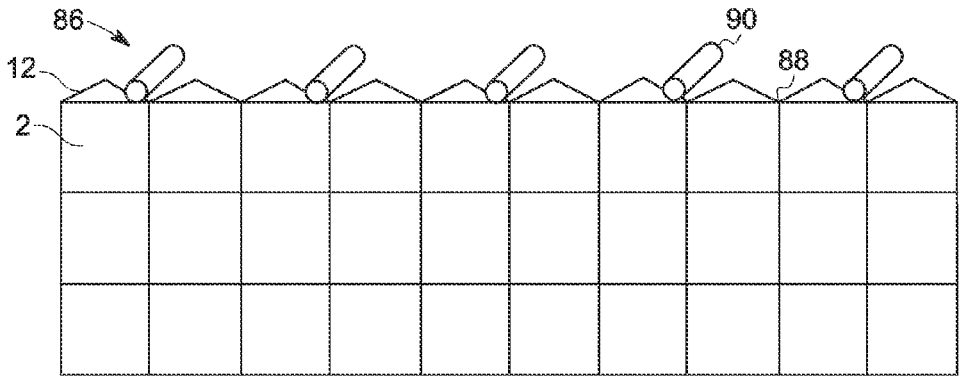
Figure 13A:
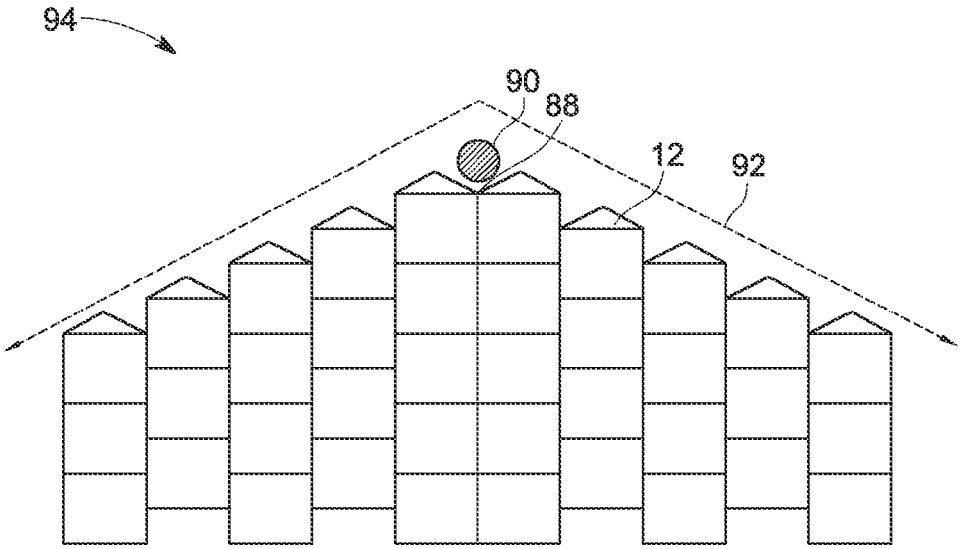
FIGS. 13A and 13B illustrate wall and roof designs using containers of the embodiments.

The embodiments of the invention may be used in the construction of effective shelter and roofing solutions. Materials and methods to construct a roof may vary by world region and depend upon materials locally available. Referring to FIG. 12A, exemplary modular containers are stacked and interlocked to form a structure 84, which is illustrated in a plan view. FIG. 12B shows a wall side view 86, and how pyramid-shaped top ends 12 of each container 2, when interlocked side-by-side, form V-slots 88 that may receive roofing members 90 of practically any form that provide support for a flat style roofing cover. Combining V-slots 88 with an offset spacing of containers, as illustrated in FIG. 10B, for opposing walls provides for a pitched roof 92 even for the simplest of shelters, as shown in wall side view 94 of FIG. 13A. An arrangement of a roof cross member that nests easily and securely in the top "V" slot of each opposing wall is possible. The staggered vertical arrangement of the wall units results in each side of the pitched roof to align neatly.

Figure 13B:
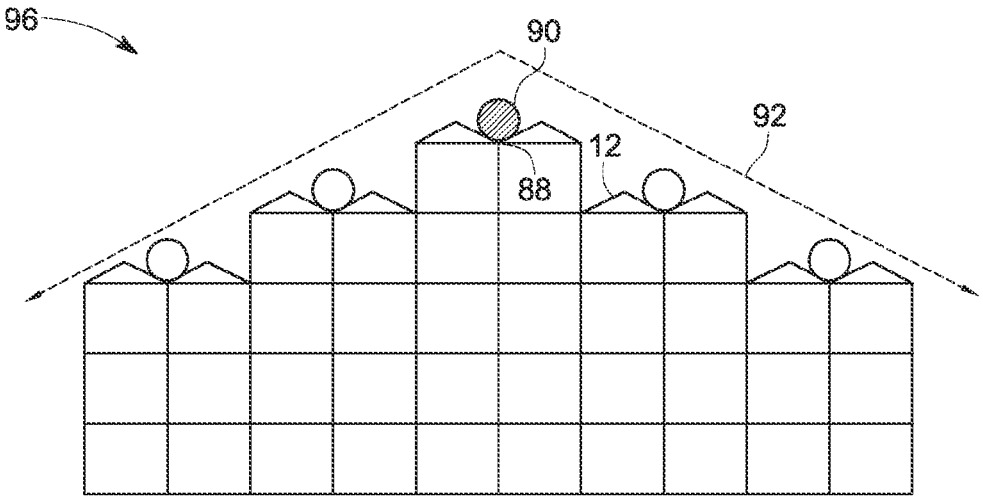

An alternative embodiment to a pitched roof for a shelter is also illustrated in a side view of wall 96 in FIG. 13B. A builder may prefer to retain a simpler, non-staggered construction arrangement of modular interlocking containers but still desire to have pitched roof 92 align so that roofing cross members 90 can fit as closely as possible in each V-slot 88 between vertical container columns, thereby lending alignment, strength and overall snugness to the resulting structures.

Close alignment of the roof slopes is a function of height to width ratio of the underlying cuboid main body unit. In some embodiments, the greater the height-to-width ratio, the steeper the pyramid top pitch must be to align neatly. The exemplary design accommodates these tradeoffs. For shelters desired to be constructed with a pitched roof, a height-to-width ratio of exemplary container 2 ranges between approximately 1:1 and 2:1. This ratio accounts for a combined advantage of lower center of gravity for each container and the 1:2 ratio for a sloping roof that is common on many roofs worldwide. The range of ratios provided should not be understood as limiting, however. One skilled in the art will recognize that other ratios are useful and possible.

Figure 14:
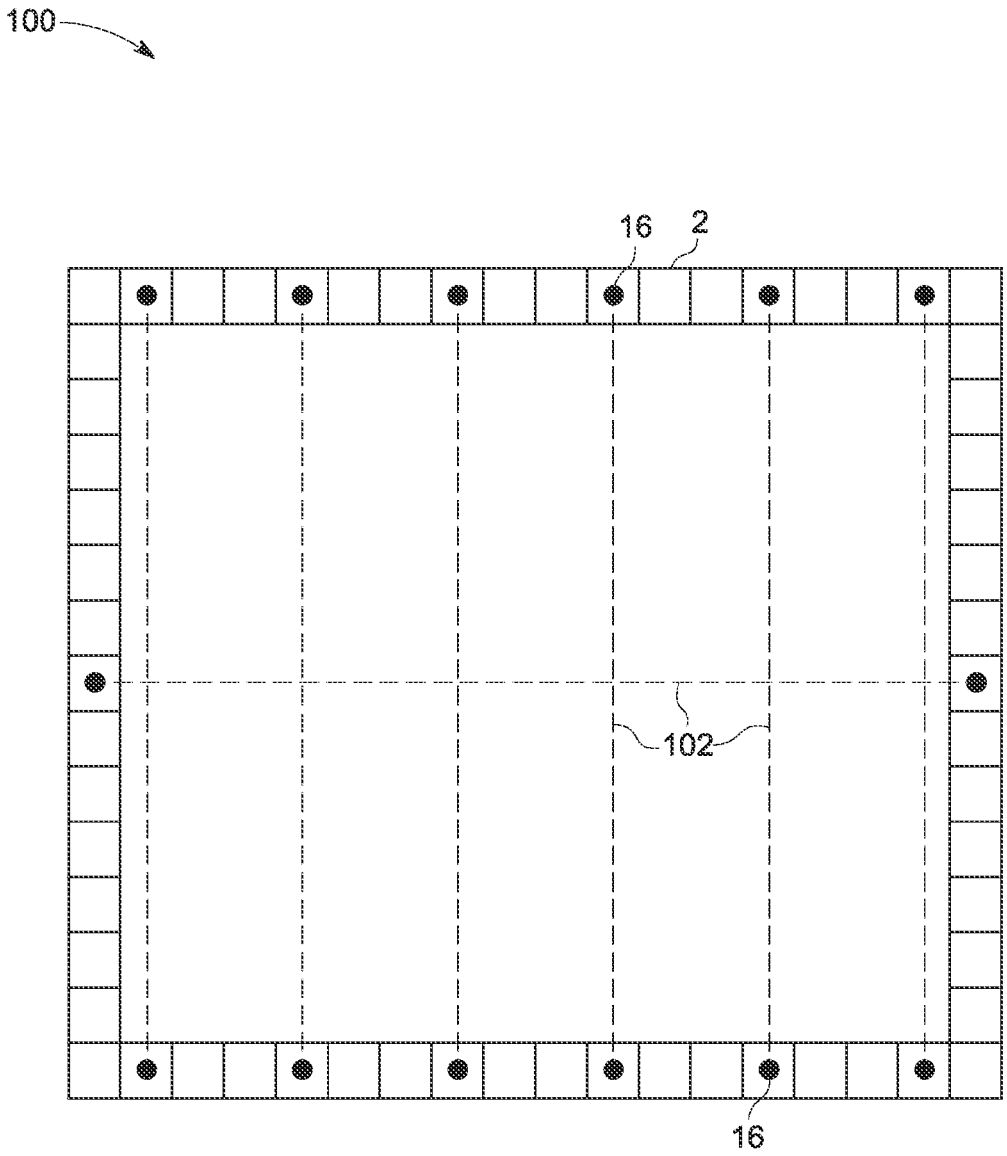
FIG. 14 illustrates a wall and roof construction using containers of the embodiments.

Referring to FIG. 14, a walled structure 100 built with modular interlocking containers 2 of the embodiments is illustrated in plan view. To form in an additional way a roof over shelter 100, rope, wire or cords 102 are tied and stretched between opposing wall structures, thereby providing support for a canvas, plastic tarp, or other roofing cover materials. As shown in FIG. 3, neck 18 of container 2 is slightly elongated as it protrudes away from top end 12. Neck 18 provides an area around which to secure cords or rope 102 to cover the exposed area within shelter 100. Cap 16 prevents cords 102 from slipping off of each container 2. This configuration provides the builder an anchoring device from which to extend a tight line along certain roof axes, creating a grid upon which one can place or stretch roofing material such as grasses, fronds, large leaves, tarps, plastic sheeting, etc. If solid roofing members, such as plywood or aluminum sheeting, are available and desirable, then cap 16 on each top row container provides a stable and versatile base for tying down roof members and roofing material.

Figure 15:
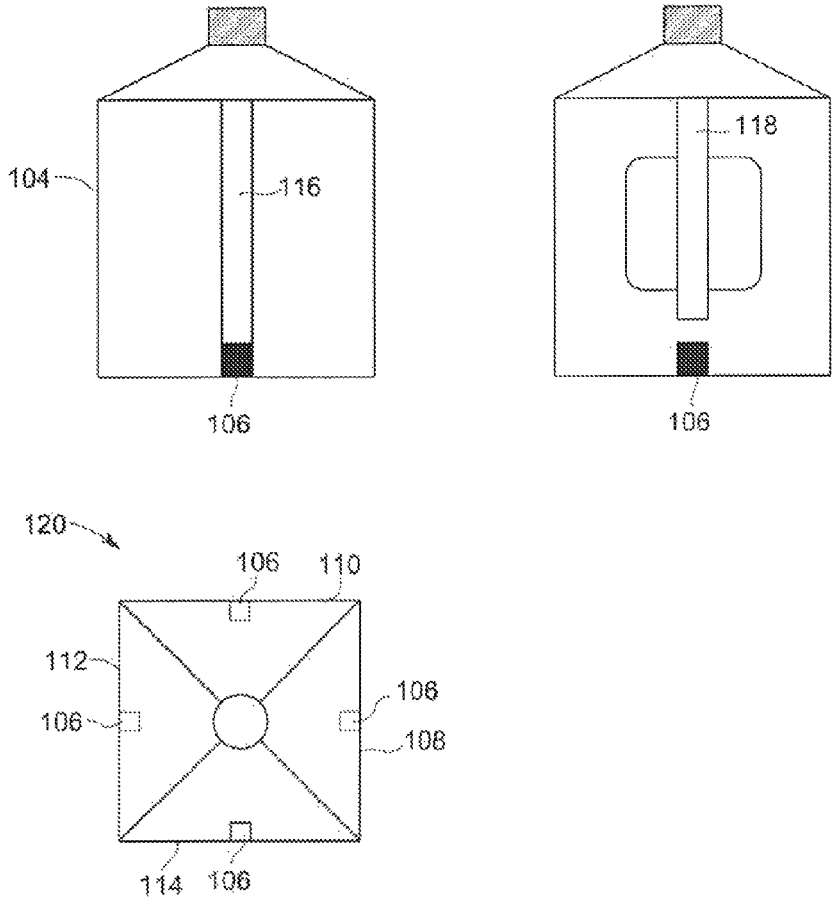
FIG. 15 illustrates an embodiment of a modular container with a pass-through notch in its base.

FIG. 15 illustrates alternative embodiments of container 2, where an allowance is made for under-girding support and pass-through wires around the container. A modular interconnected container 104 is formed similar to container 2 with an addition of a notch 106 that is formed at the central base of each sidewall 108, 110, 112, 114 at the base of each of three interlocking recessed grooves 116. A notch 106 is thereby also formed under handle 118. Placing a corresponding notch at the bottom end 120 of container 104 allows an underpassage of wires for additional support and interconnection. One example would be to add horizontal support for bridging a doorway.

Figure 16:
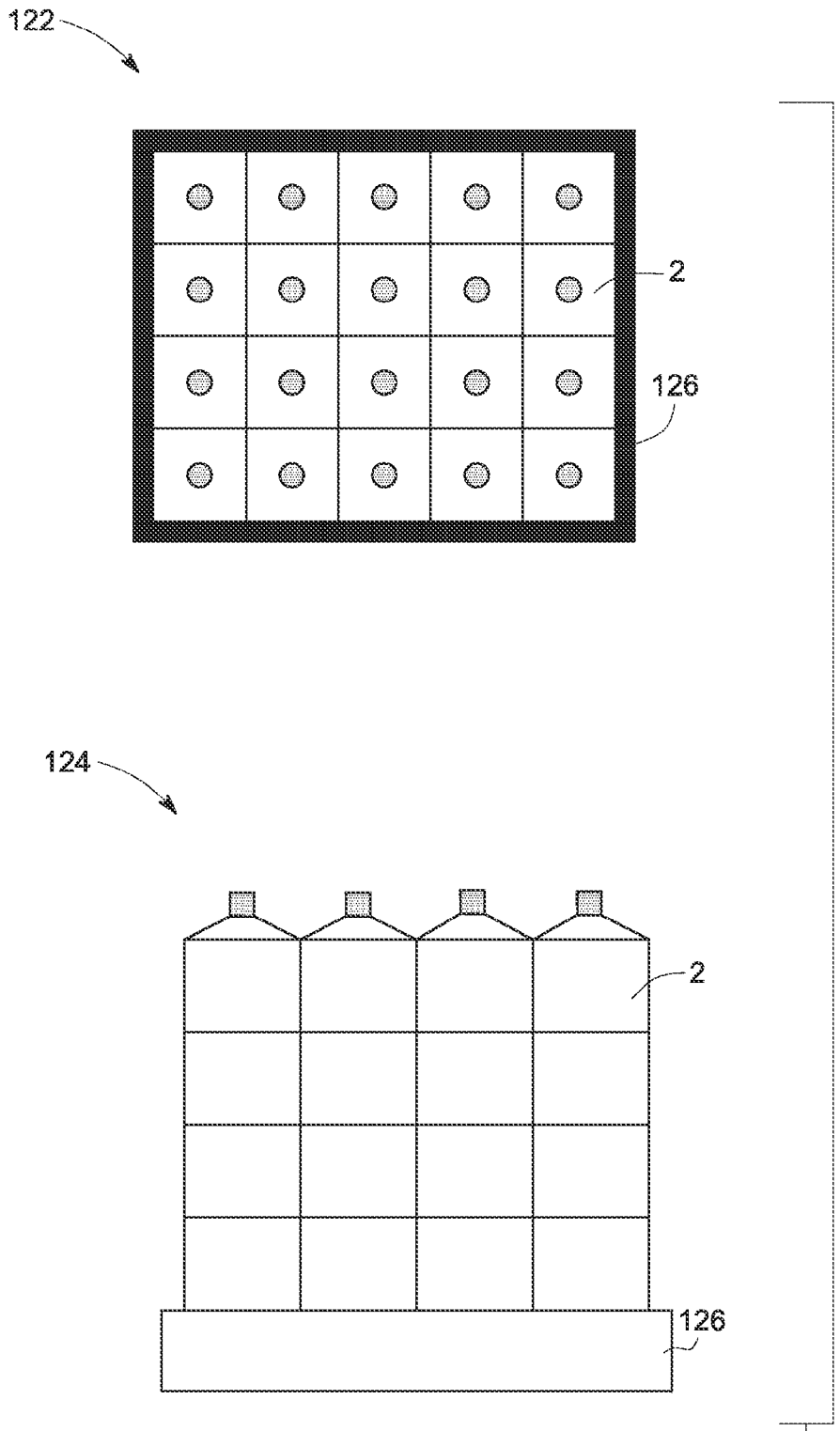
FIG. 16 illustrates a packing arrangement for shipping exemplary containers.
Figure 17:
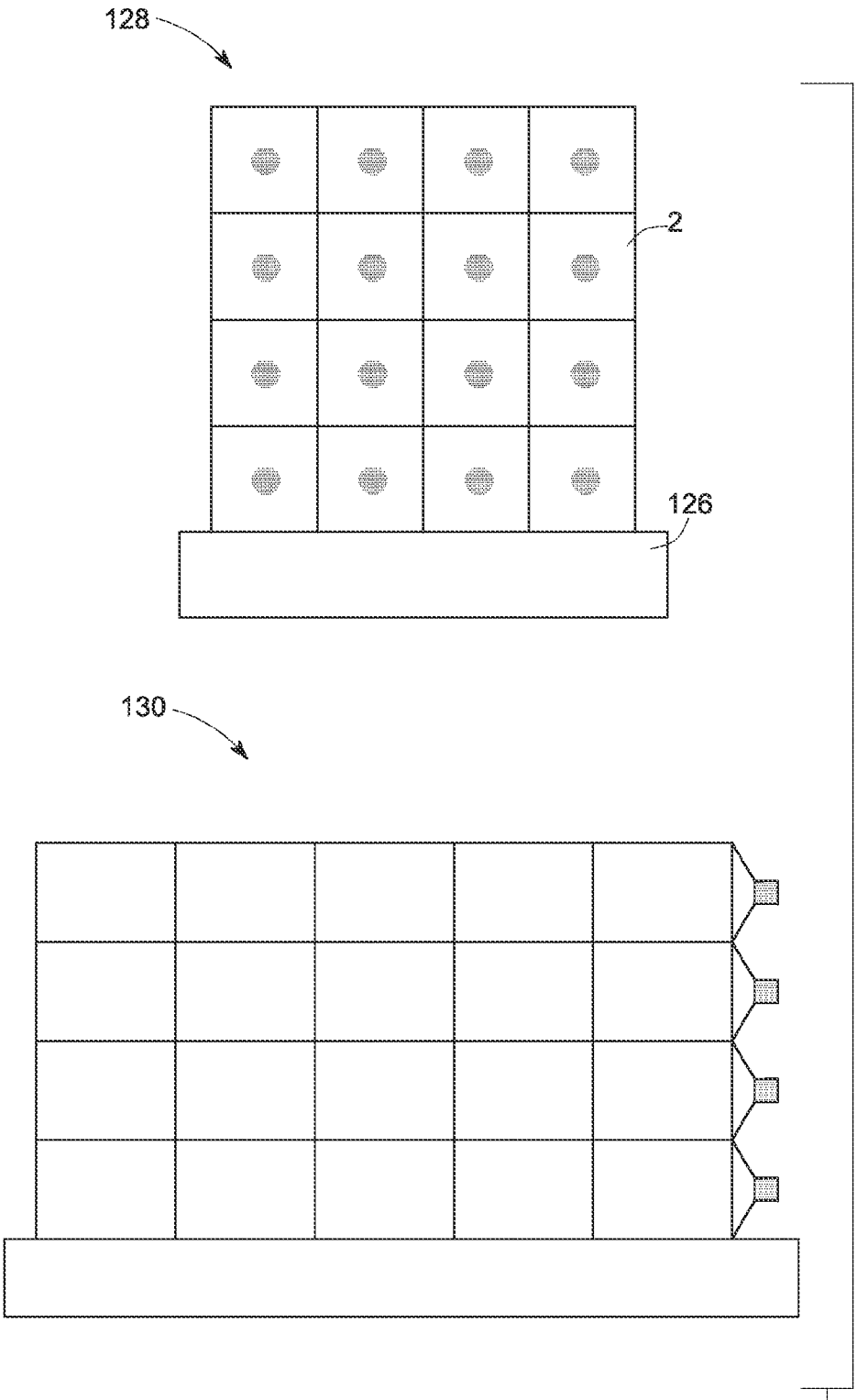
FIG. 17 illustrates a packing arrangement for shipping exemplary containers.

Regarding realities of shipping and handling, including the need to palletize goods to prevent shipping damage, ease of transport, and minimize wasted space, the exemplary container 2 provides for advantages in shipping and transportation. FIG. 16 illustrates a plan view 122 and side view 124 of palletized containers 2 that have been securely interlocked together and prepared for shipping. Pallet 126 can be any size of common pallet in the marketplace, such as the Imperial measure 40 inch by 48 inch pallet, very near to the European pallet 1000 mm by 1200 mm (39.37 inches by 47.24 inches). Each of these sizes is a reasonably close fit for a block of containers, where each container measures approximately nine inches square at the base, holding about 10 liters. Approximately twenty containers of a ten liter volumetric capacity can stand upright and neatly fit on each layer (equaling 36 inches by 45 inches) in each block, thereby leaving 1.5 to 2.0 inches border of pallet between the edge of a unit and the edge of the pallet 126. All handles of containers 2 can be turned inward and inserted into a recessed groove of the nearby container, thereby leaving no protrusions extending, minimizing damage to the containers and creating a more efficient shipping size. Likewise, FIG. 17 illustrates two side views of palletized containers. View 128 is a side view looking directly at top ends of interlocked containers that are oriented in a horizontal, instead of vertical, position on pallet 126. View 130 is a side view of the container unit in view 128. Such a stacking orientation results in similar advantages as palletized clusters 122 and 124. The exemplary volumes and sizes discussed herein are useful and efficient. One skilled in the art will recognize that given the near perfect scalability of the containers, a large range of sizes and volumes can be configured to meet shipping and use demands.

Figure 18A:
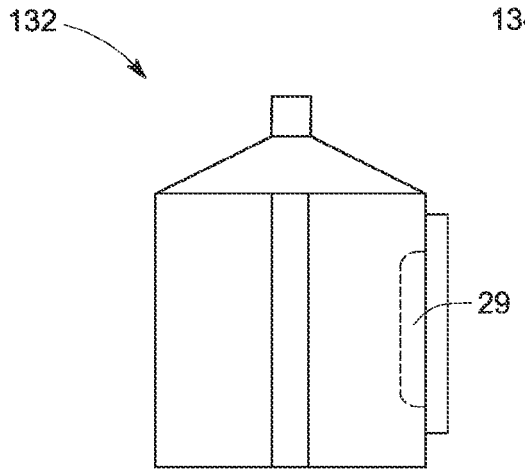
FIGS. 18A to 18C illustrate varying volumetric sizes of exemplary modular containers.
Figure 18B:
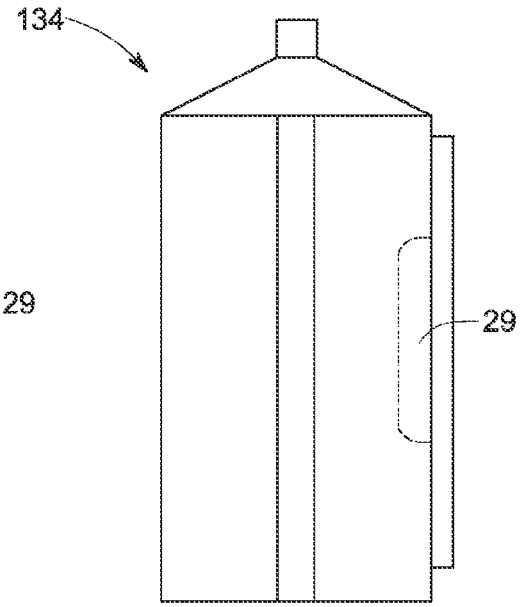

Referring to FIGS. 18A, 18B, 18C, and 19, embodiments form various volumetric and physical sizes of modular interconnected containers but maintain an identical depth in their footprint. In FIGS. 18A and 18B, each container 132 and 134 is formed with a cuboid design of one handle and three recessed grooves having a squared footprint of similar depth with a 3:1 modular interconnectivity described in relation to container 2. Container 134 is twice the vertical height of container 132 but maintains the same horizontal depth, thus providing approximately twice the volumetric capacity as container 132.

Figure 18C:
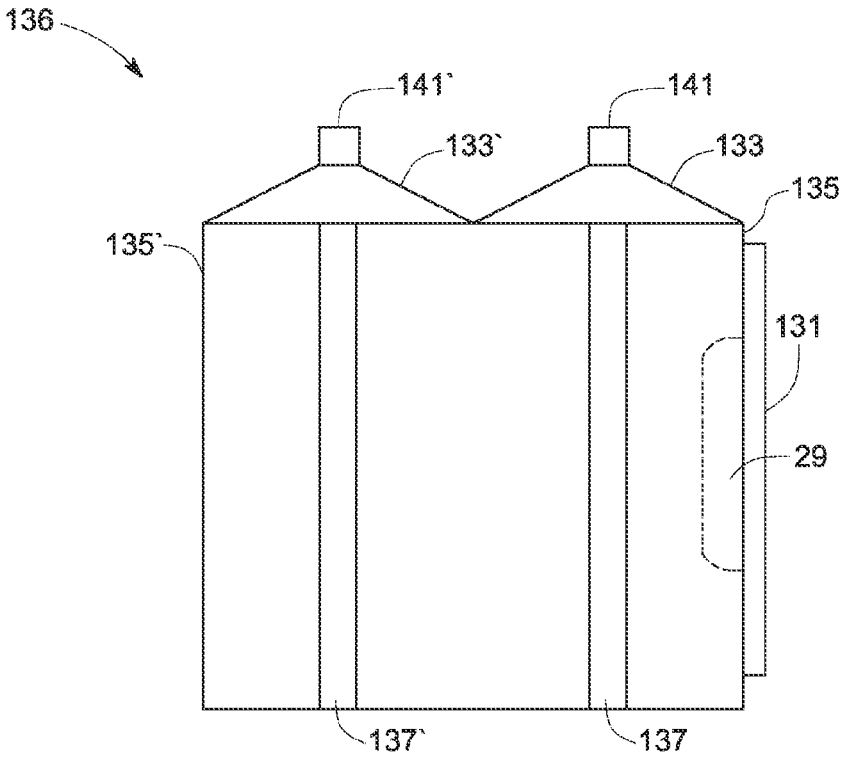

FIG. 18C shows another embodiment where container 136 comprises a construction design of one handle 131 and five recessed grooves 137 on a rectangular footprint. Container 136 appears as two containers 135, 135' but is in fact a single container. There is no dividing wall separating two similarly formed "halves" 135 and 135'. Although container 136 is designed as single container, it maintains the interconnectivity features as if two container shapes with individual pyramidal top ends 133, 133' and recessed pyramidal bottom ends had been joined together. Interlocking mechanisms are formed on the walls of each container and spaced around the perimeter to allow side-to-side and vertical interconnectivity with individual or joined containers of similar square footprints and similar depths. Container 136 has a 2:1 footprint that equates to a volumetric capacity roughly four times that of container 132 and roughly double that of container 134. The footprint of container 136 is the same depth as containers 132 and 134 thereby allowing vertical interlocking with square footprint embodiments such as containers 132 and 134. A double cap arrangement 141, 141' and bottom end pyramidal indentions are maintained for vertical connectivity with other containers. Bottom ends of container halves 135, 135' are each formed similar to bottom end 14 illustrated in FIGS. 3 and 4, and thus receive individual pyramidal top ends from other containers in a stacked arrangement. Cap 141' could be a "dummy" cap used only for connectivity while cap 141 is a working cap that covers an opening for filling and pouring contents. Alternatively, both caps may be retained as working flow apertures. Thus, unit 136 could be stacked on top of two individual containers 132 that are interconnected.

Figure 19:
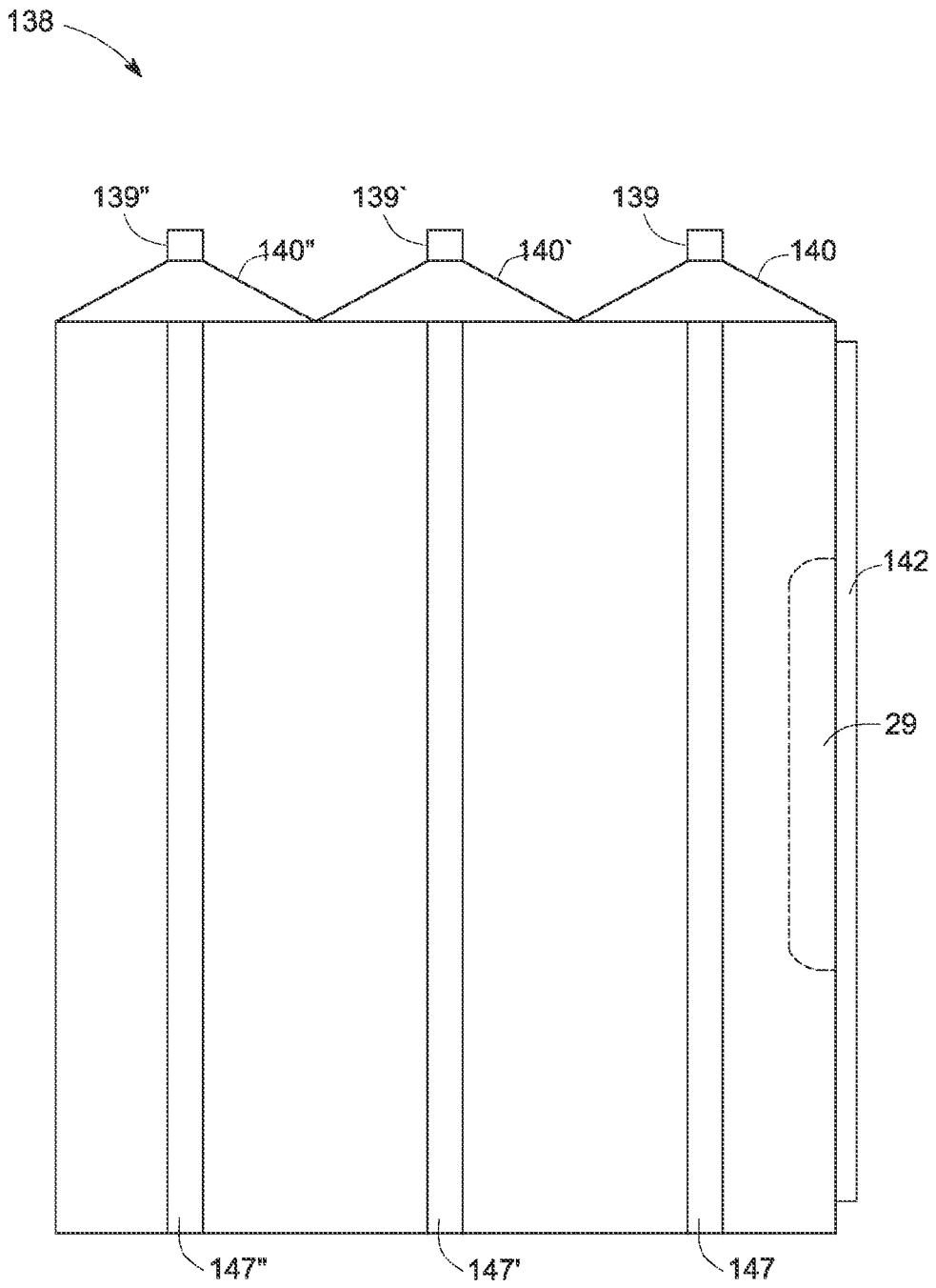
FIG. 19 illustrates a varying volumetric size of an exemplary modular container.

In other embodiments, modular container 138, illustrated in FIG. 19, is a single continuous container. Container 138 has seven lateral grooves and handle 142 for interlocking connectivity, thereby maintaining side-to-side and vertical interlocking modularity (only side view grooves 147, 147' and 147" are shown). Container 138 is formed on an extended rectangular total footprint with modular interconnectivity features otherwise similar to modular container 2. Container 138 is formed with a 3:1 horizontal rectangular footprint comprising duplicated individual container shapes 140, 140', and 140". While modular unit 138 is three times the height and three times the width of container 132, it shares the same depth as container 132 such that it has roughly nine times the volumetric capacity as container 132. The triple-spout top section 139, 139', and 139" allows vertical integration with square footprint versions of the exemplary containers described herein. With the triple-spout arrangement, all three caps could cover an opening or caps 139' and 139" (or just one of them) could be "dummies" used for vertical connectivity but offering no access to fill container 138 while cap 139 covers the actual access opening for filling and pouring of contents.

In all of the embodiments in FIGS. 18-19, the resulting container depth is identical and the handles all cross-connect with recessed grooves. An advantage of the embodiments is flexibility to allow different filling materials (e.g., water, grain, cooking oil, etc.) to be delivered in different volumes as distributors and consumers see fit, and yet still retain universal interconnectivity and identical resulting wall thickness. Thus, the design allows, e.g., volume options of 1× (see 132), 2× (see 134), 3×, 4×, 6× and 9×, roughly, of the smallest standard unit.

In some embodiments changing a total thickness of a building wall constructed with the exemplary containers can be accomplished by changing the length and width of the square footprint of a container and by changing a height of an individual container's side walls. This alternation, in turn, changes its volumetric capacity. For example, a 10 L capacity container having a cuboid design of equal width, depth, and height would have a total depth of approximately nine inches. If in a container with the same 10 L capacity the height were raised by 50%, the walls would be approximately seven inches deep (or "thick") instead of nine inches in order to maintain the same volumetric capacity. The result is an extra 20% of wall area for the same volume of goods delivered. Certain field considerations also can account for design variations.

For example, professional aid workers in camps for dislocated persons quite often rely on drinking water supplies different from those the majority of residents use. Most often these are in the form of bottled water imported from some distance away. It follows that personal use comports better with a smaller sized container, perhaps no larger than a 2 L or 2.5 L capacity container. A 2-2.5 L cuboid design for a container 2 results in an approximate 5-5.5 inch square base of the container. The embodiments include a variety of volumetric capacities but have a similar square base size such that an arrangement of different volumes of containers side-to-side will be similar, but the heights of containers having different capacities will likewise differ. Each should retain interchangeable side-to-side interconnectivity and retain top-to-bottom vertical interconnectivity.

Therefore, embodiments of sized containers include a container 132 holding 2-2.5 L volumetric capacity. Container 134, which is vertically twice the height as container 132, can hold a 4-5 L volumetric capacity. Container unit 136 has a volumetric capacity of approximately 8-10 L, or about four times that of 132. Container unit 138 is a single container thrice the vertical height and thrice the horizontal width as container 132, but with the same depth as container 132, resulting in a 3:1 ration footprint and a volumetric capacity of approximately 18-22.5 L, or about nine times that of 132. One skilled in the art will recognize that the perfect scalability of the containers can yield a large number of volumetric capacity ranges and combinations.

Figure 20:
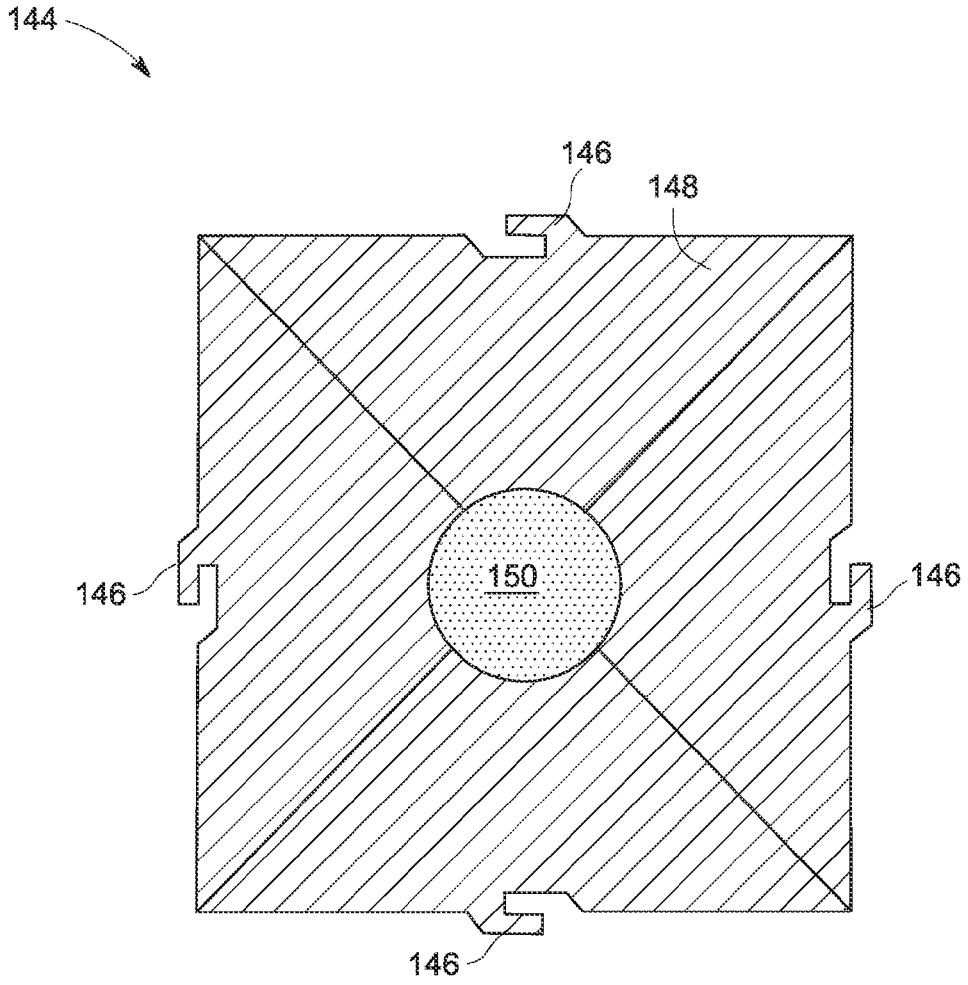
FIG. 20 illustrates a plan view of an interlocking mechanism of other embodiments.

Referring to FIG. 20, another embodiment for a scalable, interlocking modular container is shown. A plan view for a modular interlocking container 144 has similar features to those comprising container 2 but provides for a modification of the interconnectivity mechanism as a hermaphroditic connection mechanism. Top end 148 is formed with a pyramidal rise from each of four side walls that form a neck, upon which is secured a cap 150. Instead of a handle 26, container 144 includes an interlocking wedge or protrusion 146 that is formed with a corresponding recessed groove at the center of each side wall for use as a side-locking mechanism. Interlocking wedges 146 are formed with shorter angled lines that are modified to create concave curves or other recessions under the widest surface of the wedge connector 146. The square shaped base profile of container 144 and nested interlocking mechanisms 146 preserve the advantages and efficiencies of packing and shipping as a unit and the advantages of a top-down assembly method as described for other embodiments.

Figure 21:
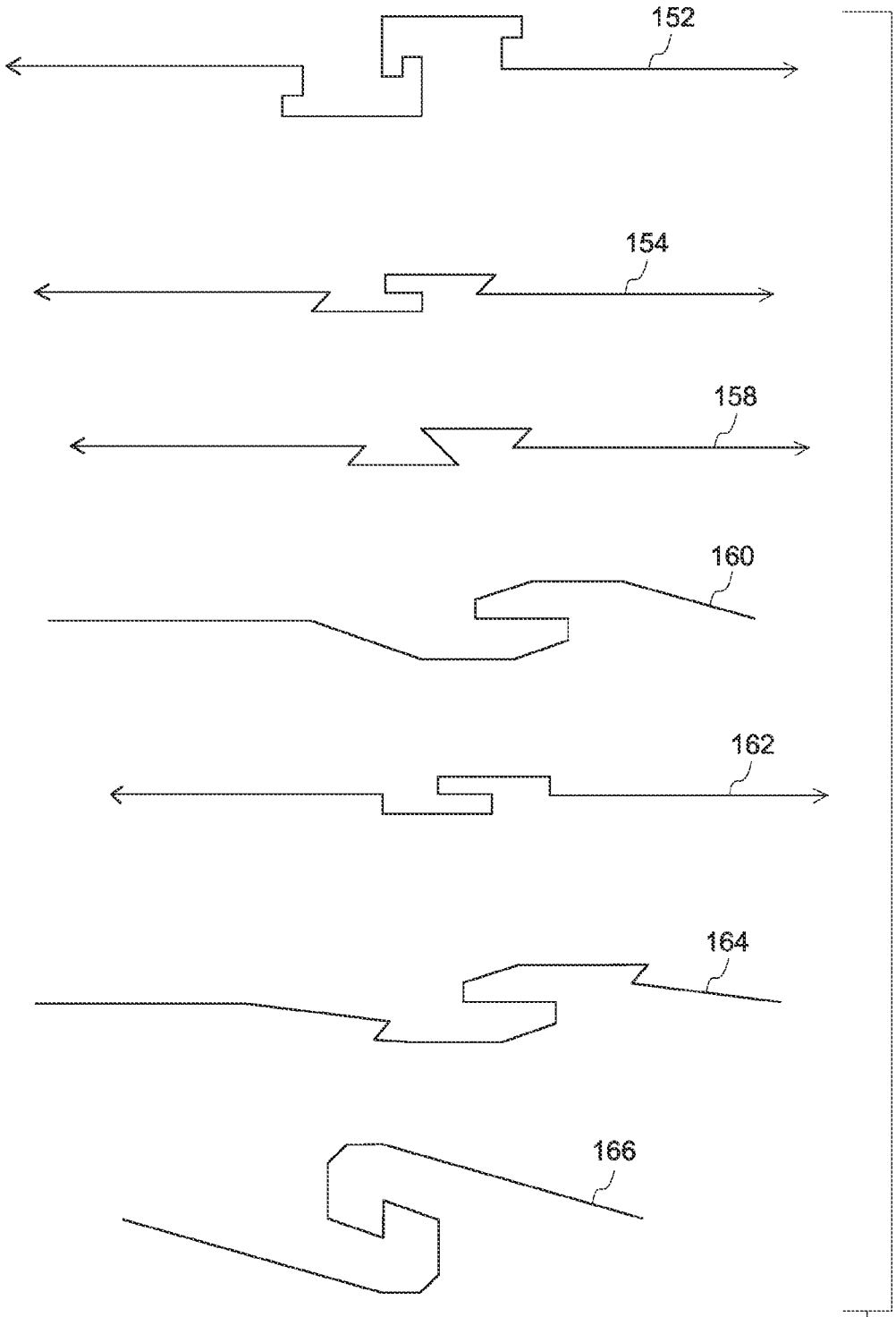
FIG. 21 illustrates alternative embodiments of interlocking mechanisms for exemplary containers.

Interlocking wedge 146 design is not limited to a specific implementation in the embodiments. FIG. 21 illustrates various embodiments of interlocking mechanisms for wedge 146 alternatives 152-166, all of which employ a cantilevered wedge or protrusion overlapping a recessed groove. These connection mechanisms are each "hermaphroditic," meaning they possess both male and female aspects in a single connector. These embodiments of hermaphroditic connectors can be applied to any of the connecting mechanisms employed by container embodiments described herein, except those that do not mount a handle on the container, i.e., the 3:1 container as described in relation to FIGS. 1-19.

Other embodiments of various-sized hand-held interlocking containers can be formed as vessels without an adjoining handle such as handle 26 on container 2. For the purposes of illustration—but not to suggest scaling limits—the following table lists embodiments of various container sizes for variations of container 144.

| Volume | Dimensions |
|---|---|
| 250 mL cuboid | interior: 2.48"; Exterior: approx. 2¾" depth × 2¾" width × 4¾" height (2¾" side + 2" top/cap) |

-continued

| Volume | Dimensions |
|---|---|
| 500 mL square based column | Exterior = approx. 2¾" depth × 2¾" width × 7½" height (5½" side + 2" top/cap) |
| 750 mL square based column | Exterior = approx. 2¾" depth × 2¾" width × 10¼" height (8¼" side + 2" top/cap) |
| 1 liter rectangular based column | Exterior = approx. 2¾" depth × 5½" width × 7½" height (5½" side + 2" top/cap) |
| 1.5 liter rectangular based column | Exterior = approx. 2¾" depth × 5½" width × 10¼" height (8¼" side + 2" top/cap) |
| 1 liter square based column | Exterior = approx. 2¾" depth × 2¾" width × 13" height (11" side + 2" top/cap) |
| 2 liter rectangular based column | Exterior = approx. 2¾" depth × 2¾" width × 13" height (11" side + 2" top/cap) |

Figure 22A:
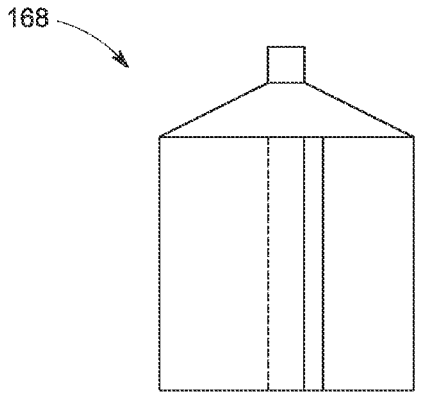
FIGS. 22A-22E illustrate varying volumetric sizes of modular containers of FIG. 20.
Figure 22B:
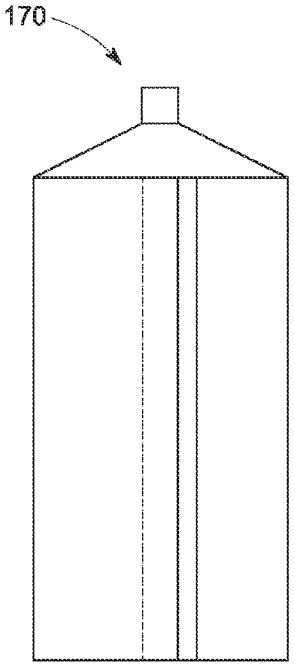
Figure 22C:
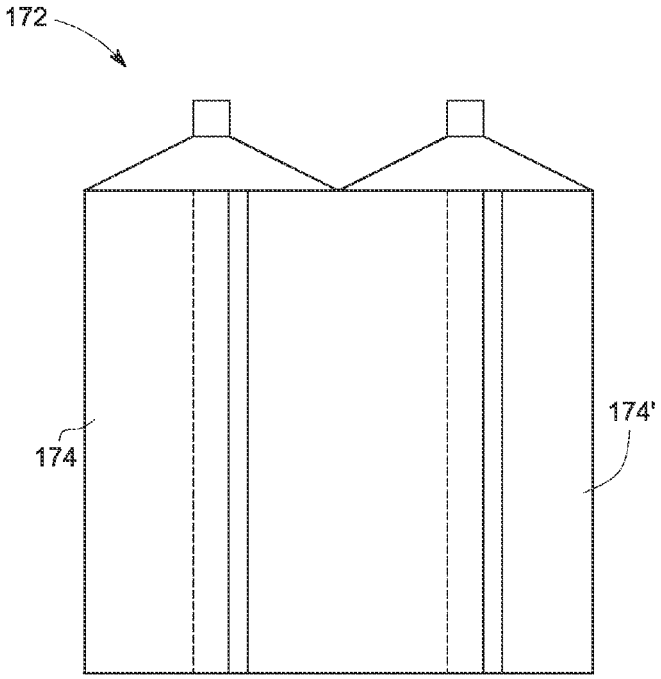
Figures 22D, 22E:
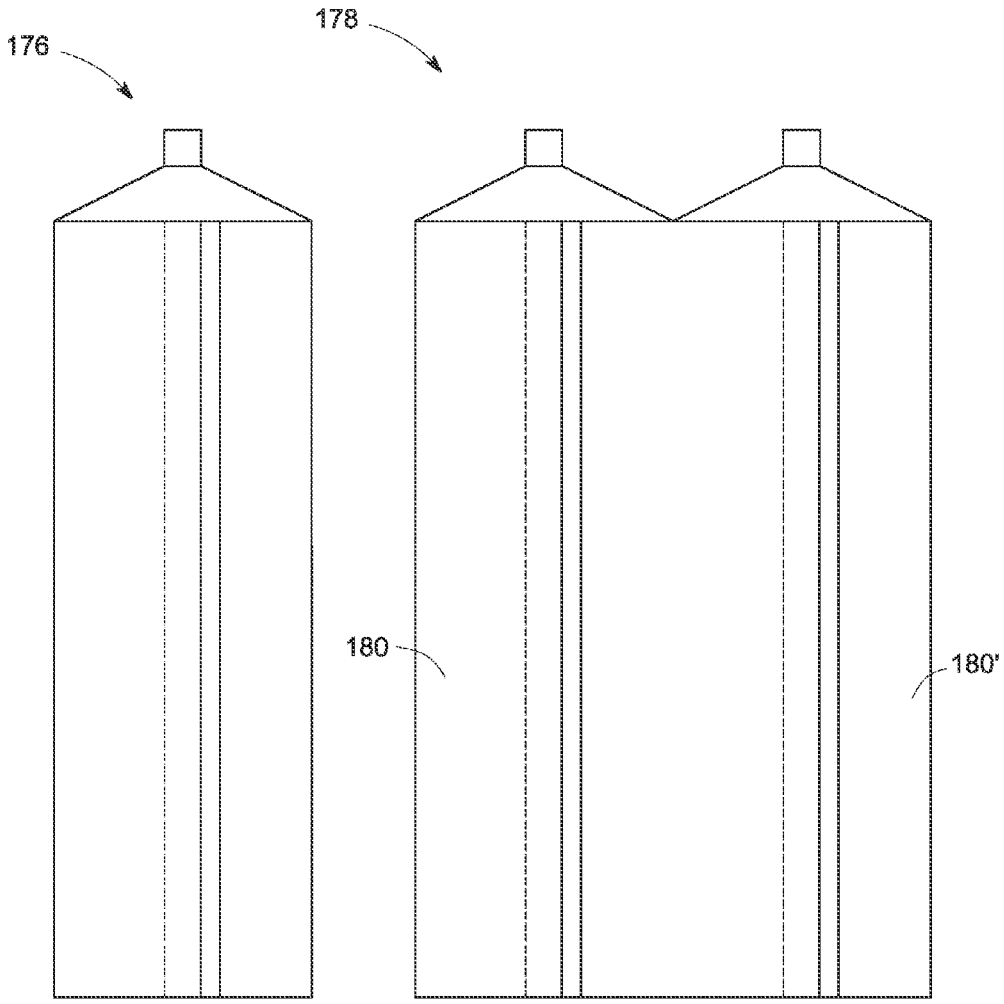

FIGS. 22A-22E illustrate exemplary sizes of interlocking bottles utilizing an hermaphroditic wedge mechanism. In FIG. 22A, exemplary container 168 is illustrated as a 250 mL cuboid design, comprising a square footprint with approximately the same size wall height as the width and depth of the container. FIG. 22B shows exemplary container 170 that is approximately twice the height as container 168 and has approximately a 500 mL volumetric capacity. Exemplary container 172 achieves roughly twice the volumetric capacity of container 170 and four times that of 168 by creating a single container with a 2:1 ratio footprint and the same height and depth of container 170 but with twice the horizontal width by joining two 174 "halves." FIG. 22D shows container 176 that is approximately three times the height of container 168 and has about a 750 mL volumetric capacity. Although a single container, container 178 is formed externally as if it were two halves 180 and 180' interlocked together so that vertical and horizontal interconnectivity with other container embodiments is maintained, in the same fashion as 172. Exemplary single container 178 achieves roughly twice the volumetric capacity of container 176 and about six times that of 168 by creating a single container with a 2:1 ratio footprint and the same height and depth of container 176, but with twice the horizontal width. Exemplary containers 172 and 178 each have six points of interlocking mechanisms of the sort illustrated in FIG. 20 or FIG. 21.

Figure 23:
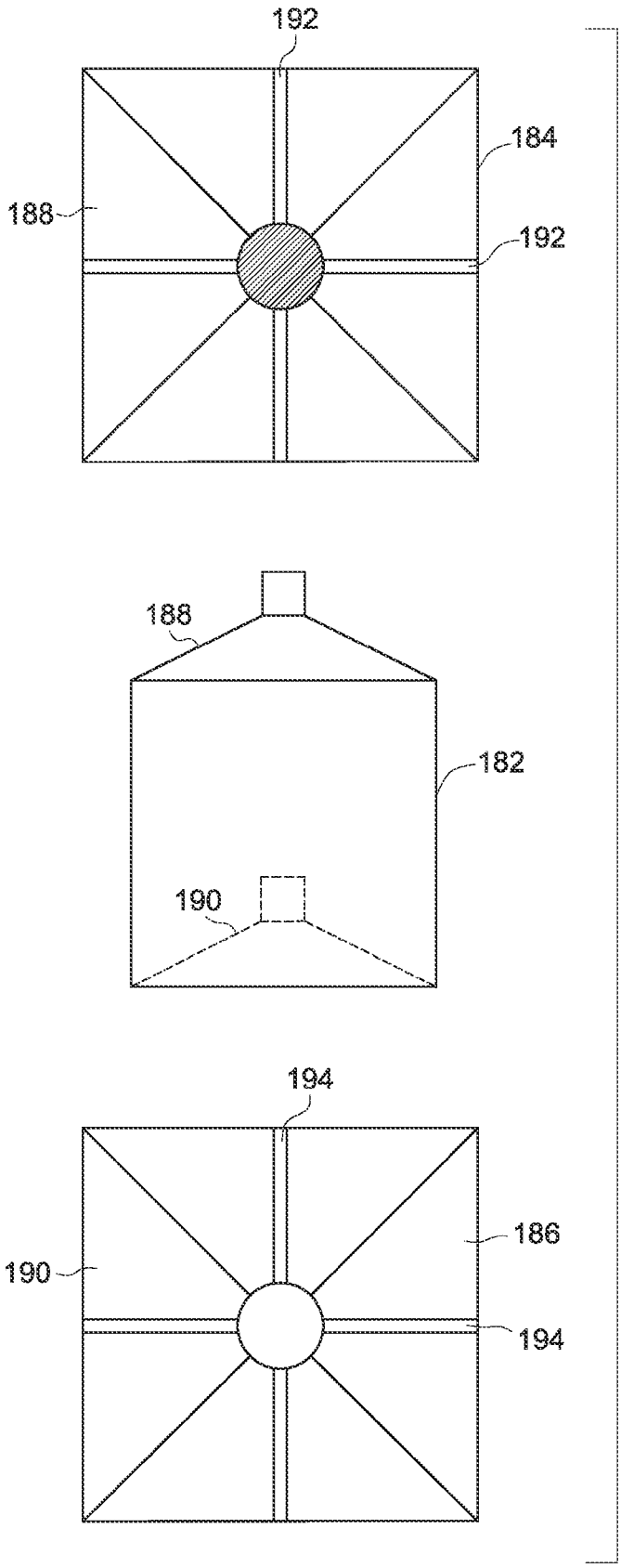
FIG. 23 illustrates an embodiment of a modular interlocking container with further vertical connectivity.

Referring to FIG. 23, other embodiments of the invention form additional mechanisms on interlocking containers of the embodiments in order to add both strength and stability to structure or shelter. In one embodiment for a cuboid design of a modular container (comprising similar features as container 2, some of which features FIG. 23 omits in order to add clarity to the modification), plan views of an exemplary top end 184 and bottom end 186 are shown. Top end 184 comprises a straight ridge 192 bisecting each of the four isosceles triangles created by the rises 188 of the pyramidal tops of container 182. Corresponding channels 194 are formed to bisect each of the isosceles triangles created by the rises 190 of the pyramidal bottoms of a container 182. When stacking two containers, channels 194 from a bottom end 186 receive ridges 192 from a top end 184 of a container stacked underneath. In other embodiments, the position of ridges and channels can be reversed, i.e., with the channels in the pyramidal tops and the ridges on the corresponding pyramidal bottoms. In other embodiments, a container 182 may have channels 194 bisecting both top end and bottom end pyramidal portions. This modification could be used to create increase the number of tie points for a container by guiding a wire, twine, or other type of cord for through a channel and around the top cap anchor to an outside or inside wall surface.

Figure 24:
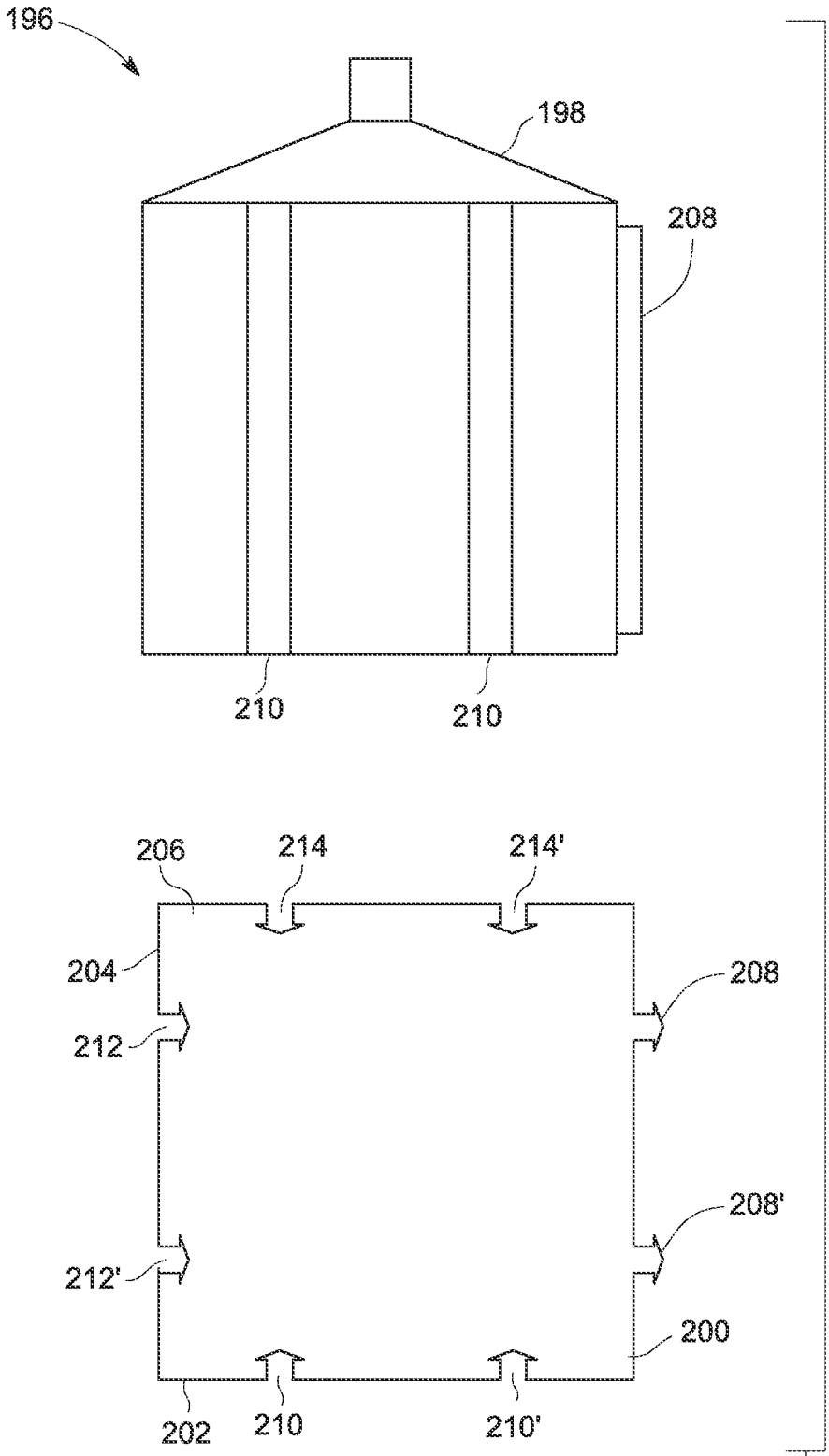
FIG. 24 illustrates an embodiment of a modular interlocking container with additional interconnectivity.

In other embodiments shown in FIG. 24, a scalable, interlocking modular container 196 comprises a pyramidal shaped top-end 198 and bottom end, and four perpendicular sides 200, 202, 204, and 206 in a cuboid design. Container 196 is formed with a pair of external handles 208, 208' that are formed in parallel and are placed laterally for the full length or nearly the full length of perpendicular wall 200. Each remaining three walls 202, 204, 206 contain a pair of lateral recessed grooves 210 and 210', 212 and 212', and 214 and 214', respectively, shaped and spaced to slidably receive a pair of handles similar to 208 and 208' from an adjacent second container. Additional grooves 210', 212', and 214' provide the ability to interlock with connecting containers at an approximate 50% offset, which creates greater flexibility in shelter construction designs and maximizes strength when doubling a horizontal thickness such as for retaining walls and defensive bulwarks. This 50% offset handle and groove design allow a departure from container 2 that allows for only right angles and straight lines for construction. Further, the additional handles and grooves can enhance a living space by providing a greater number of exterior and interior elements on which to attach wall coverings and other useful items.

Figure 25A:
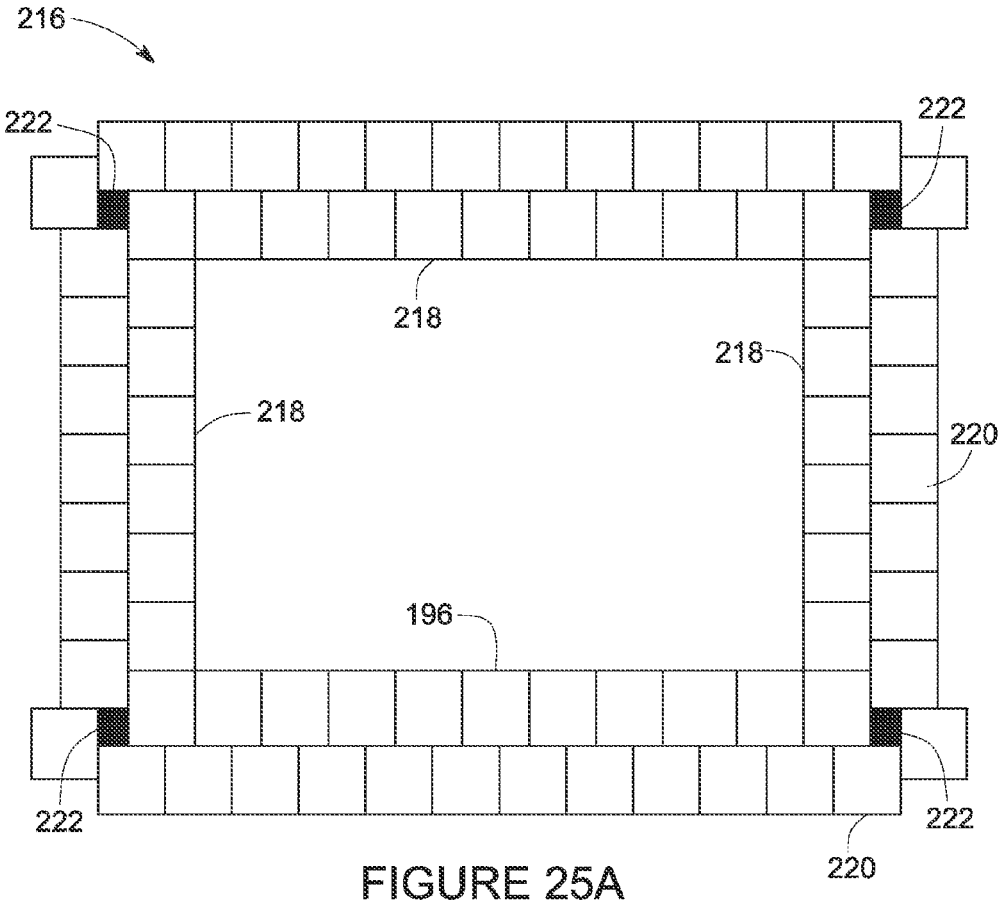
FIGS. 25A and 25B illustrate shelter structures constructed with modular exemplary containers of FIG. 24.
Figure 25B:
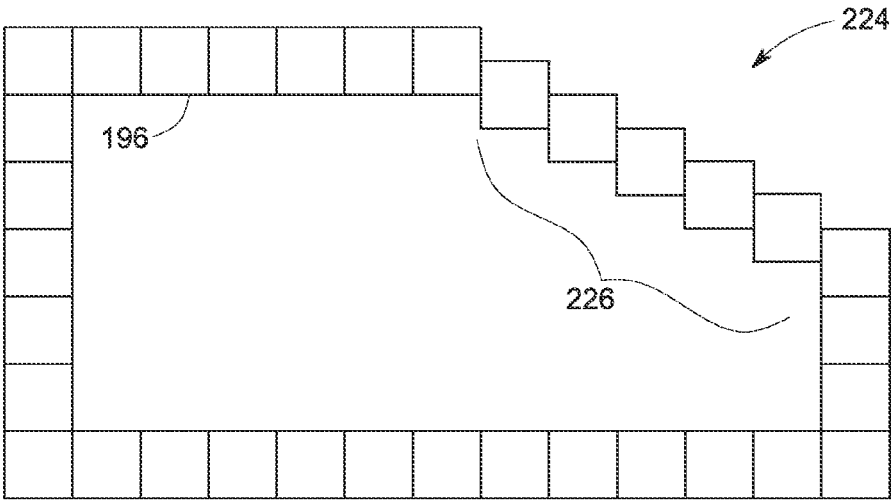

FIGS. 25A and 25B illustrate exemplary building constructions possible by using dual-handled interlocking container 196 as the modular building block. Where massing of a wall thickness or defensive security is paramount, such as in a military application or retaining wall, builders can construct shelter 216 having an inner wall 218 with a horizontally staggered outer wall 220 of interlocked containers 196 forming basic blocks of construction. Concrete, gravel, fill-dirt, or other traditional materials could be used to add filler in corner spaces 222. Referring to FIG. 25B, other possible constructions include shelter 224 that has wall 226 which is staggered at approximately 30 degrees using the embodiment 196 as the modular building block. Each interlocked container 196 is offset at 50% of the width of each preceding block to create the wall section 226.

Figure 26A:
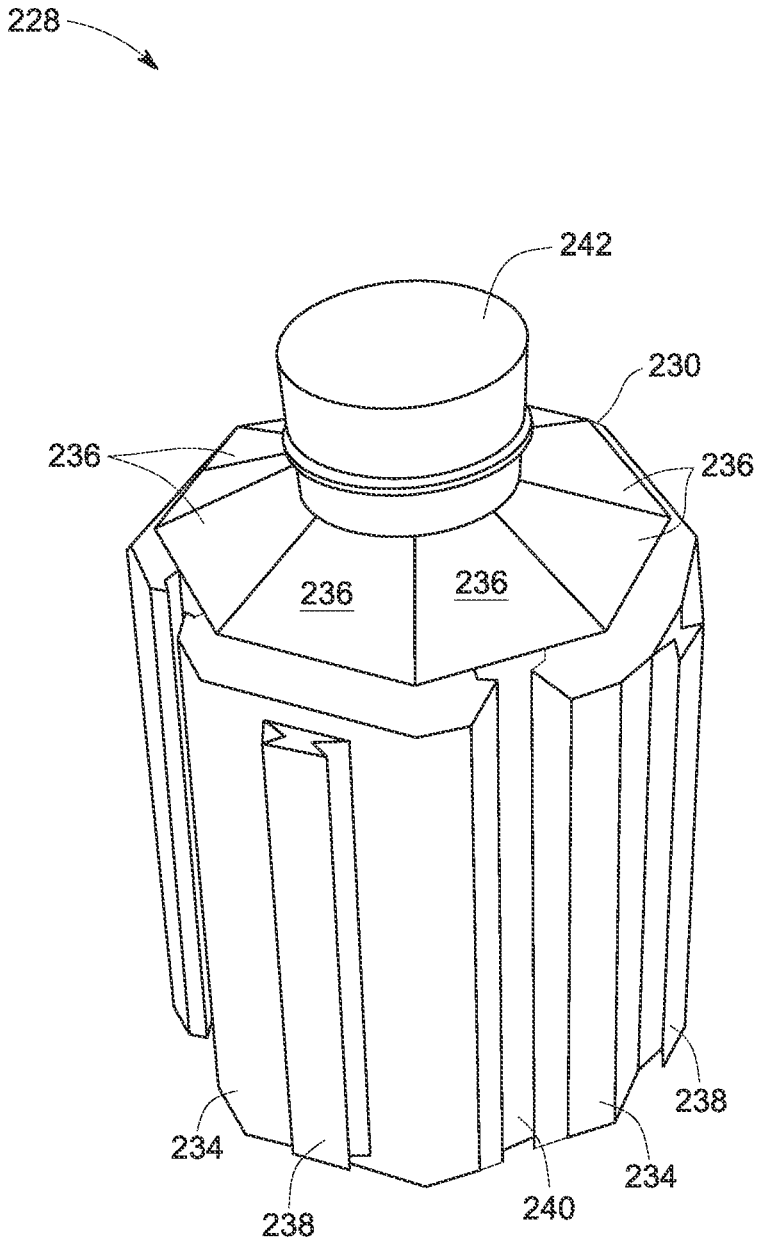
FIGS. 26A-26B illustrate an embodiment of an octagonal modular interlocking container.
Figure 26B:
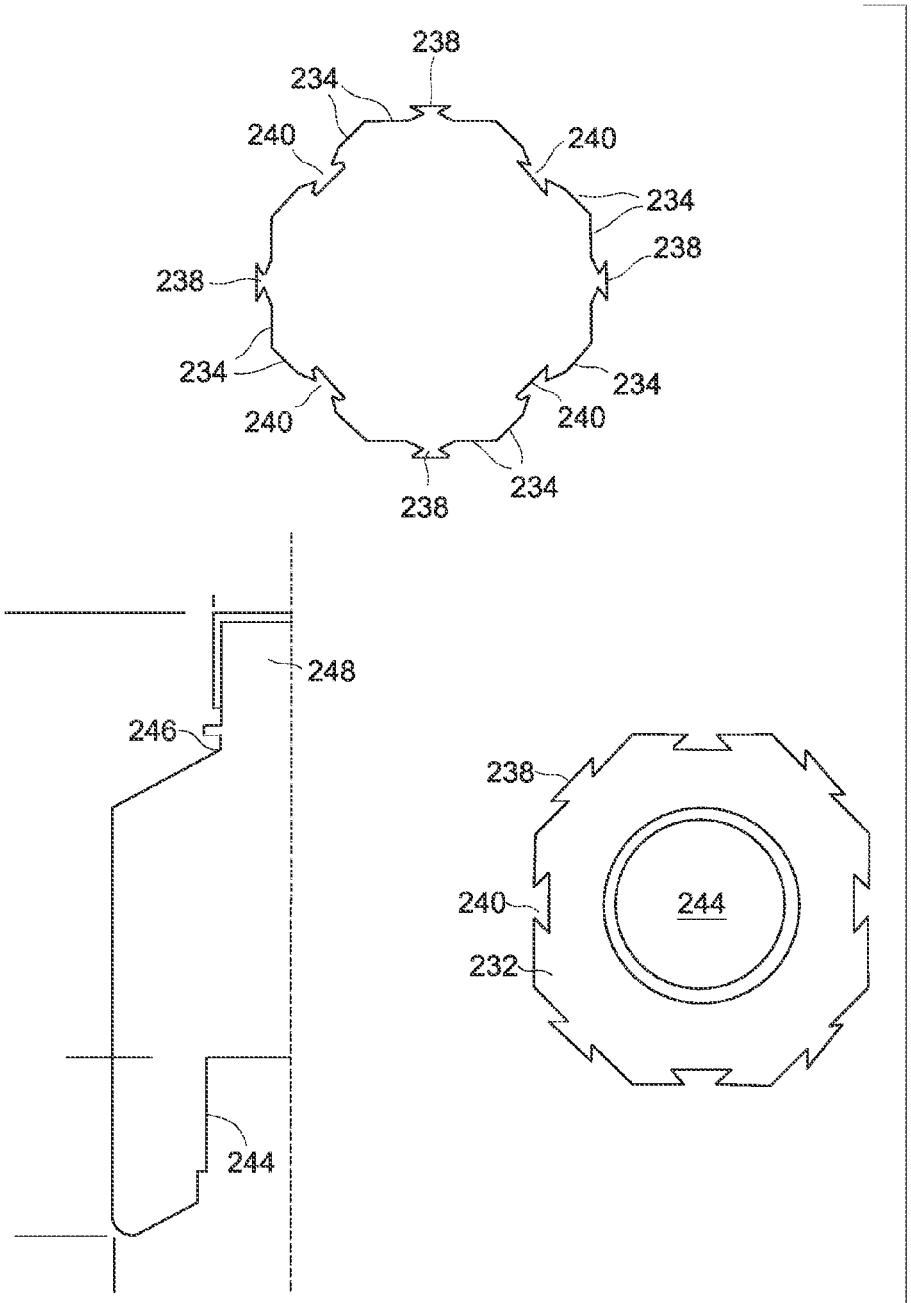

FIGS. 26A and 26B illustrate an embodiment of an interlocking modular container 228 constructed with a geometrical cross-sectional design. Although FIG. 26B illustrates the shape of the embodiment as octagonal, any number of three or more walls are within the scope of the embodiments. Container 228 includes a top end 230 and a bottom end 232 that frame eight evenly proportioned and aligned perpendicular walls 234. Top end 230 is formed with slanted faces 236 that rise from each top-edge of upright walls 234 to converge at a neck 246 and form an opening 248. Cap 242 secures to a neck 246 to hold and cover any internal contents. Container 228 can interconnect to other similarly-designed containers using various embodiments of interconnection mechanisms as described herein. For vertical interconnection, in FIG. 26B, bottom end 232 is formed in the same manner as rising faces of 236, where slanted faces in the bottom end 232 rise from a bottom edge of each side wall 234 and meet at indention 244, which is formed to receive another container's cap 242. Bottom end 232 can then receive a second container's top end that is shaped like top end 230, thereby creating a stackable interconnection.

In some embodiments, each container 228 has at least one recessed groove 240 formed along side wall 234. At least one connector wedge or tongue 238 is formed laterally along another sidewall 234. While each container has at least one groove 240 or at least one connector 238 in order to interconnect, embodiments include more than one groove 240 and/or more than one connector 238 on a container 228. FIG. 26A illustrates an exemplary container 228 having a groove 240 and connector 238 each placed on alternating wall faces 234, providing four connectors 238 and four grooves 240 per container 228. In other embodiments, modular containers are constructed with all recessed grooves on its respective walls while other containers are constructed with all wedges or tongues in its respective side walls. Separate containers are then matched in a male-to-female connection scenario.

Figure 27:
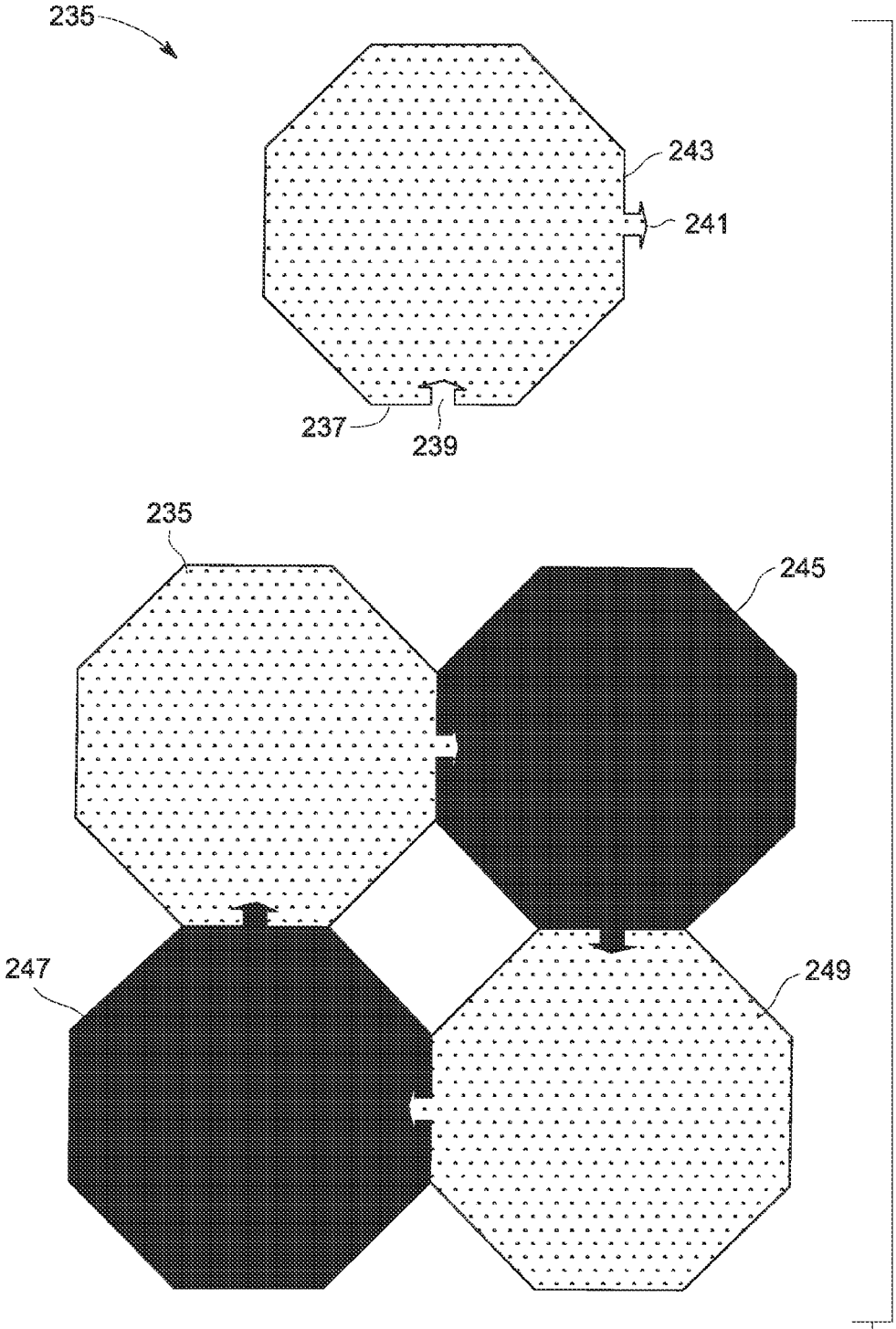
FIG. 27 illustrates an alternative embodiment of an octagonal modular interlocking container.

In some embodiments, each octagonal container has a single connection tongue or wedge and between one and seven recessed grooves formed along an equivalent number of side walls. FIG. 27 shows a cross-sectional view of an exemplary octagonal modular container 235. A connection wedge (which alternatively could be a handle) 241 is formed on side wall 243 and a recessed connection groove 239 is formed on side wall 237. An example of interconnection of a group of modular containers similar to 235 is also shown in FIG. 27, where exemplary containers 235, 245, 247, and 249 connect using the wedge-in-groove mechanism. Interconnected octagonal containers may be connected with any of the wedge, handle, and groove elements described in the embodiments, and their equivalents.

Figure 28:
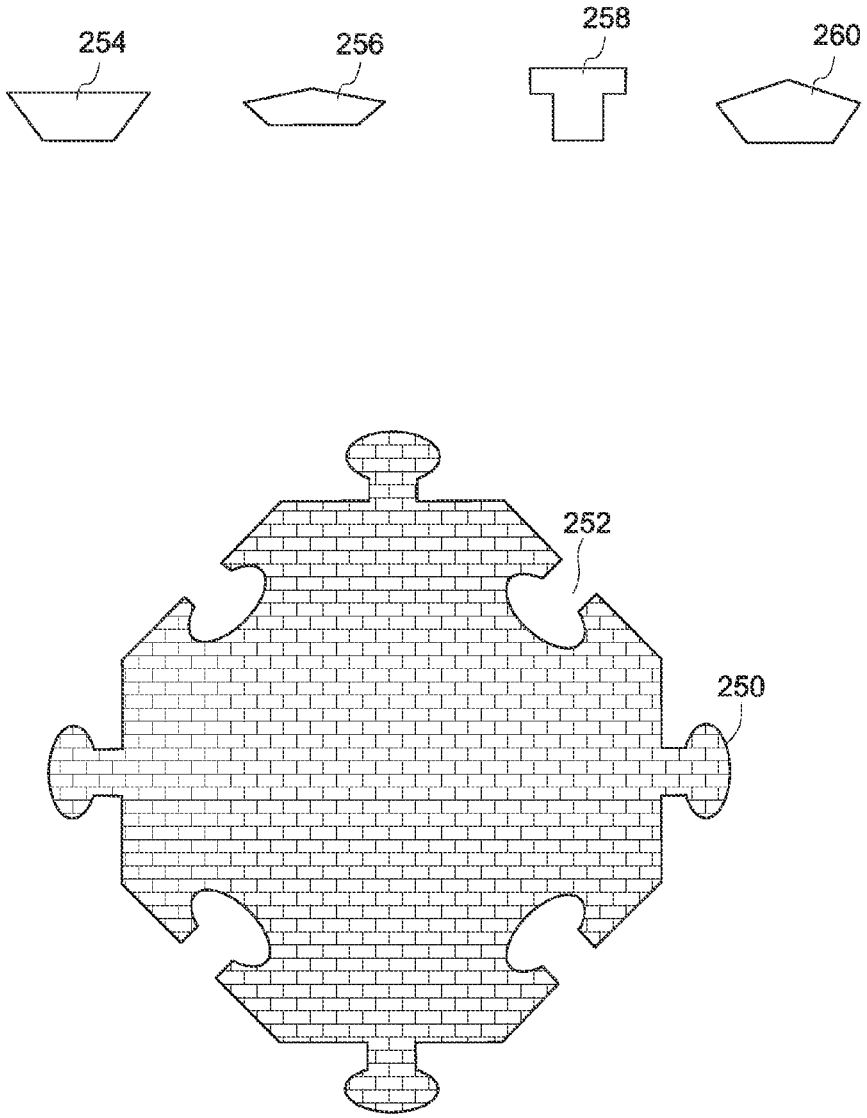
FIG. 28 illustrates additional embodiments of an octagonal modular interlocking container.

FIG. 28 illustrates a cross-sectional view of an octagonal container similar to container 228 comprising alternative embodiments of four lateral connector wedges or tongues 250 and four lateral recessed grooves 252 alternating on each side wall, where the wedge 250 is shaped with an elliptical end-piece. Alternative embodiments of connector wedge mechanisms include but are not limited to wedges 254, 256, 258, and 260 as shown, and their equivalents. When interconnected with other similar containers, strength of construction is achieved in this design due to sixteen sets of folds created by eight corners and eight connectors. The resulting pattern retains symmetry in design, which retains all the advantages of manufacturing and ease of assembly with other similar containers in addition to achieving great flexibility in design of building structures.

Figure 29:
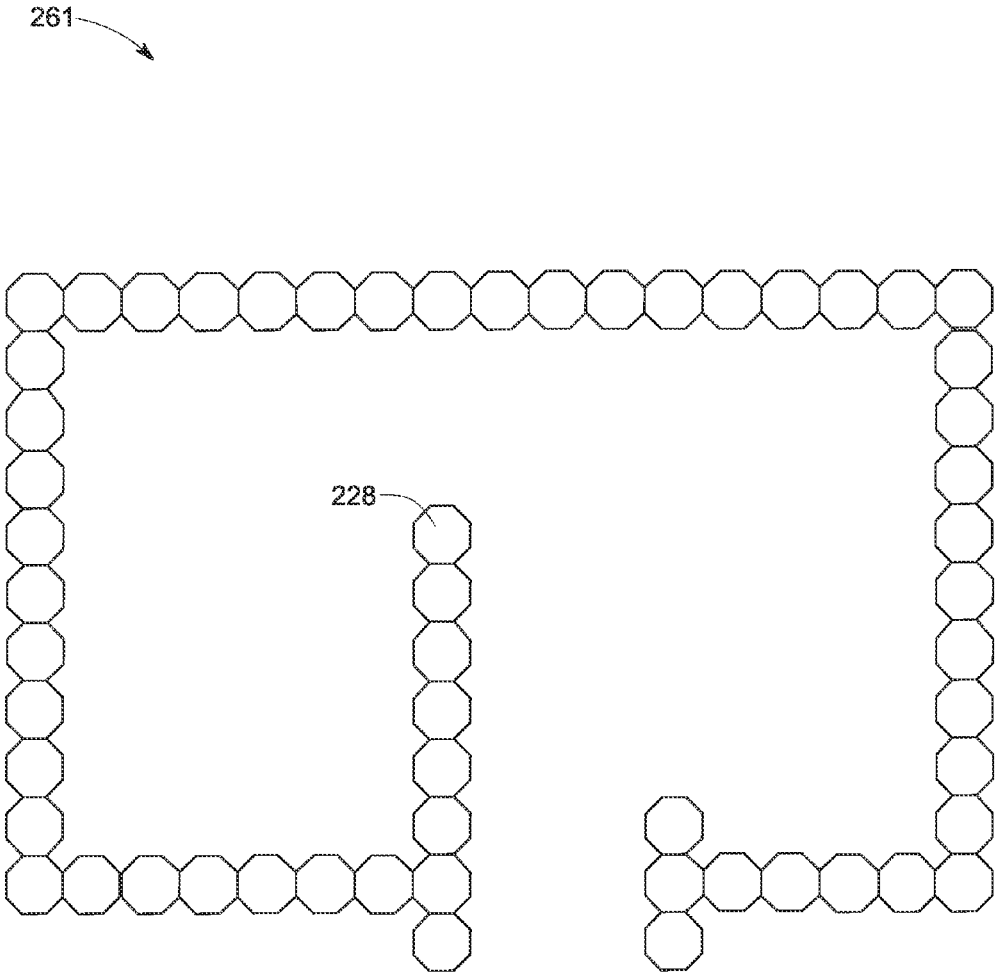
FIG. 29 illustrates an exemplary structure constructed with the octagonal modular containers of the embodiments.
Figure 30:
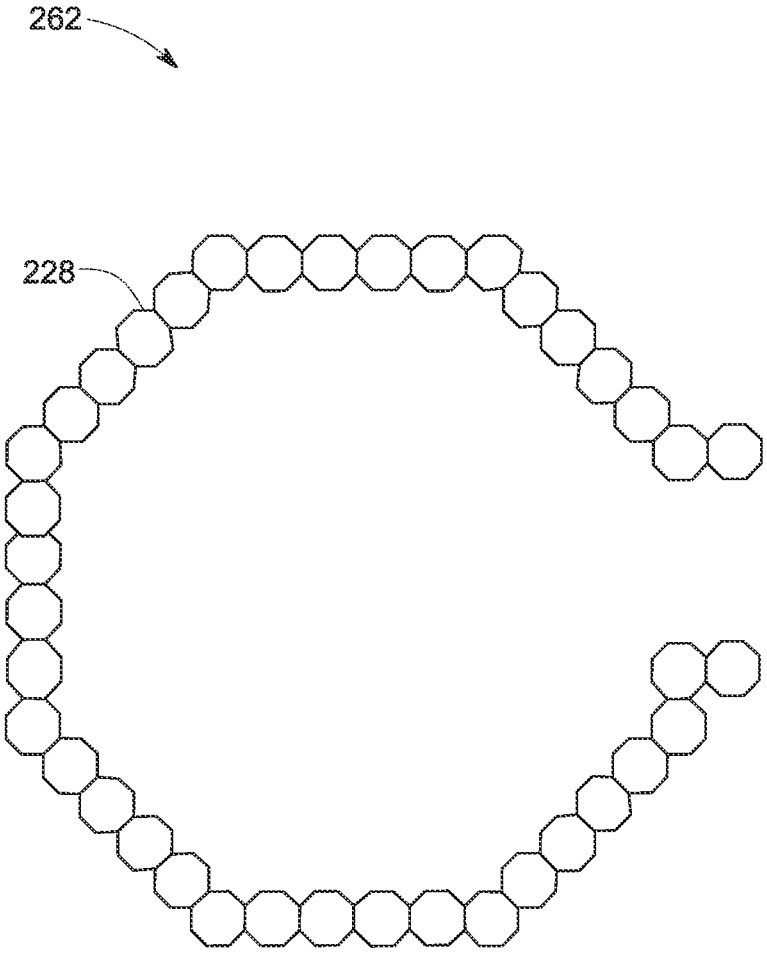
FIG. 30 illustrates an additional exemplary structure constructed with the octagonal modular containers of the embodiments.

FIG. 29 illustrates an exemplary building structure 261 that could be constructed using either the 4-wedge, 4-groove design of the octagonal container 228 (shown); alternatively, because the structure is designed with turns only at right angles, container 235 (not shown) may be used for the construction. Referring to FIG. 30, building structure 262 shows a more rounded design that is also possible due to the greater connectivity of the 4:4 octagonal container 228 used as the construction block. Double or triple massing of structure 262 is possible via the connectivity mechanisms of container 228.

Figure 31:
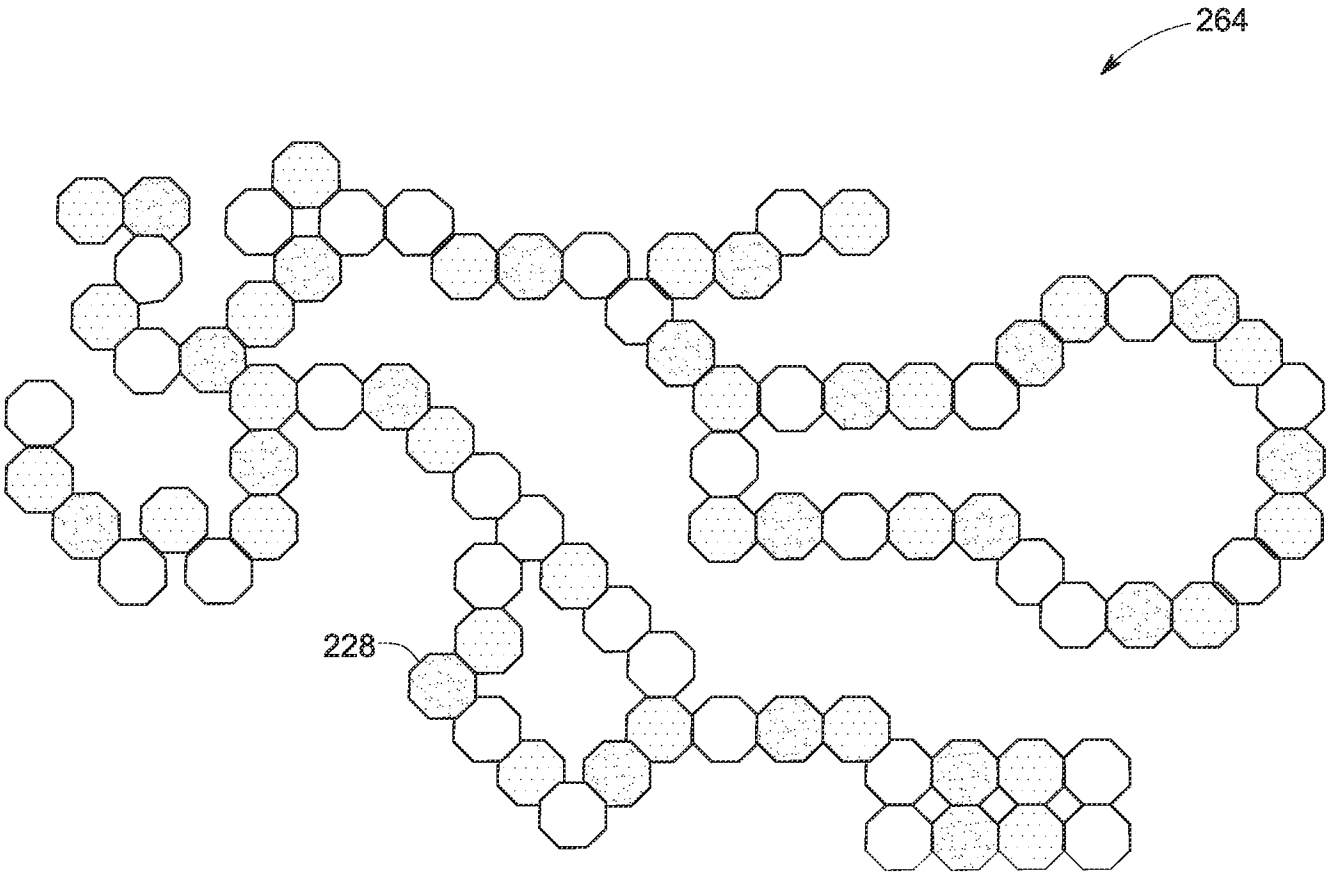
FIG. 31 illustrates additional exemplary structures constructed with the octagonal modular containers of the embodiments.

FIG. 31 illustrates other embodiments of construction possible with the 4-handle, 4-groove connectivity mechanisms of the octagonal container 228. Although the structure layout 264 is illustrated in two dimensions, multi-height, multi-depth, multi-shaded, and multi-colored structures are possible as various embodiments of containers 228 used as construction blocks. All arrangements further provide numerous connection points for additional containers or end user add-on products.

Figure 32:
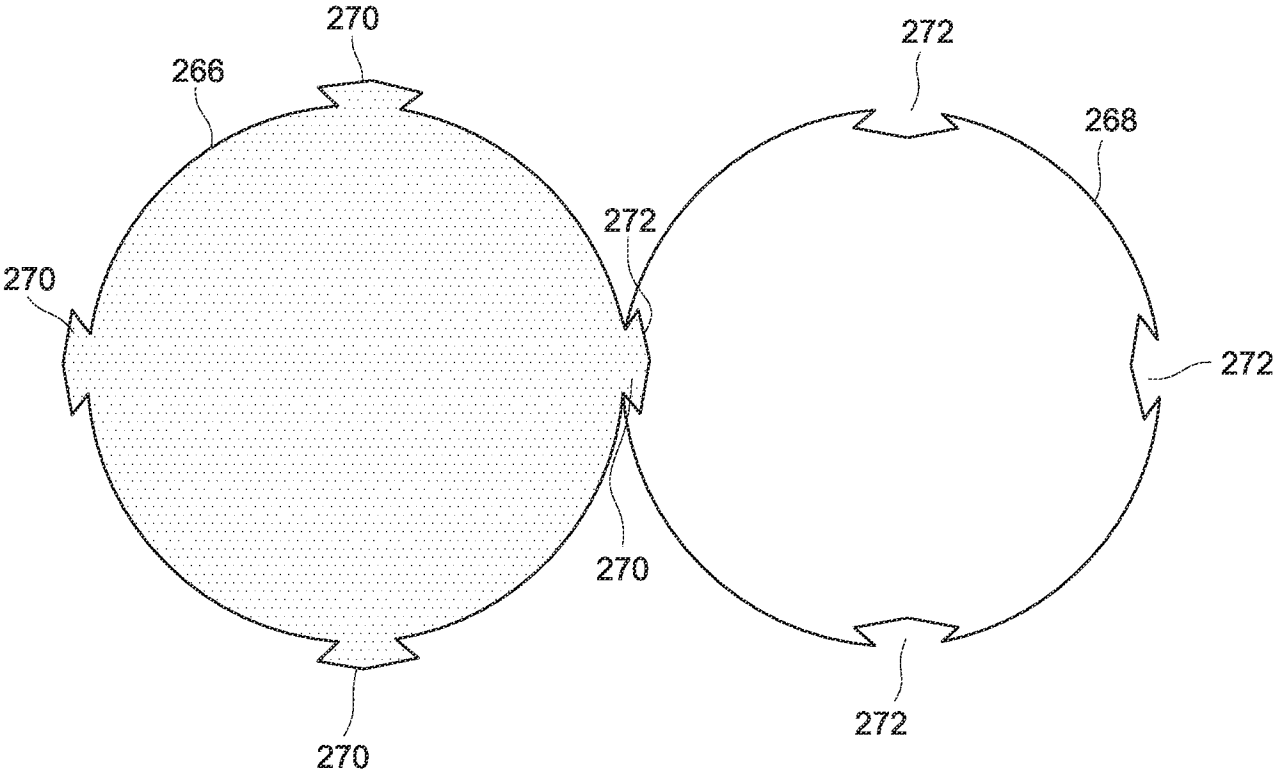
FIG. 32 illustrates an embodiment of a cylindrical modular interlocking container.

FIG. 32 illustrates how an alternative embodiment to modular container 228 is constructed with one cylindrical perpendicular wall. Two cylindrical containers are shown interconnecting in cross-sectional views 266 and 268. Lateral connecting wedge 270 is slidably inserted into lateral recessed groove 272, which each may be located at ninety degree intervals around the circumference of each container 266, 268 to create symmetry for side-to-side connections or at any suitable interval and distance. Alternatively, containers 266 and 268 may be formed having connecting wedge 270 and recessed groove 272 in an alternating male-female pattern, as a separate hermaphroditic design or as all-male and all-female connections, as shown in FIG. 32. Interconnectivity between varying heights and volumes is consistent with the mechanisms of other embodiments.

Figure 33:
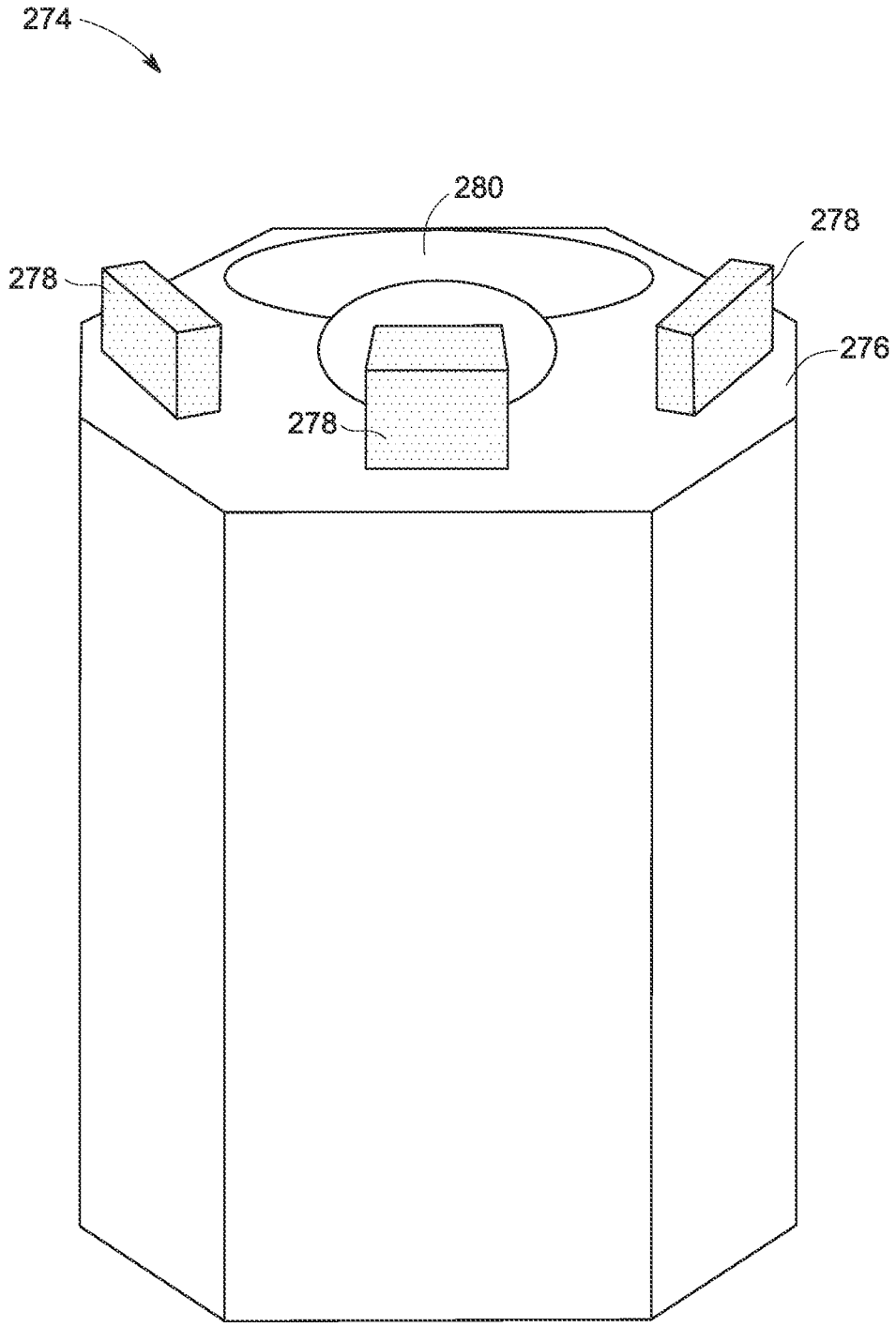
FIG. 33 illustrates an embodiment of an octagonal modular interlocking container with alternative vertical connectivity and a pop-top pour mechanism.
Figure 34:
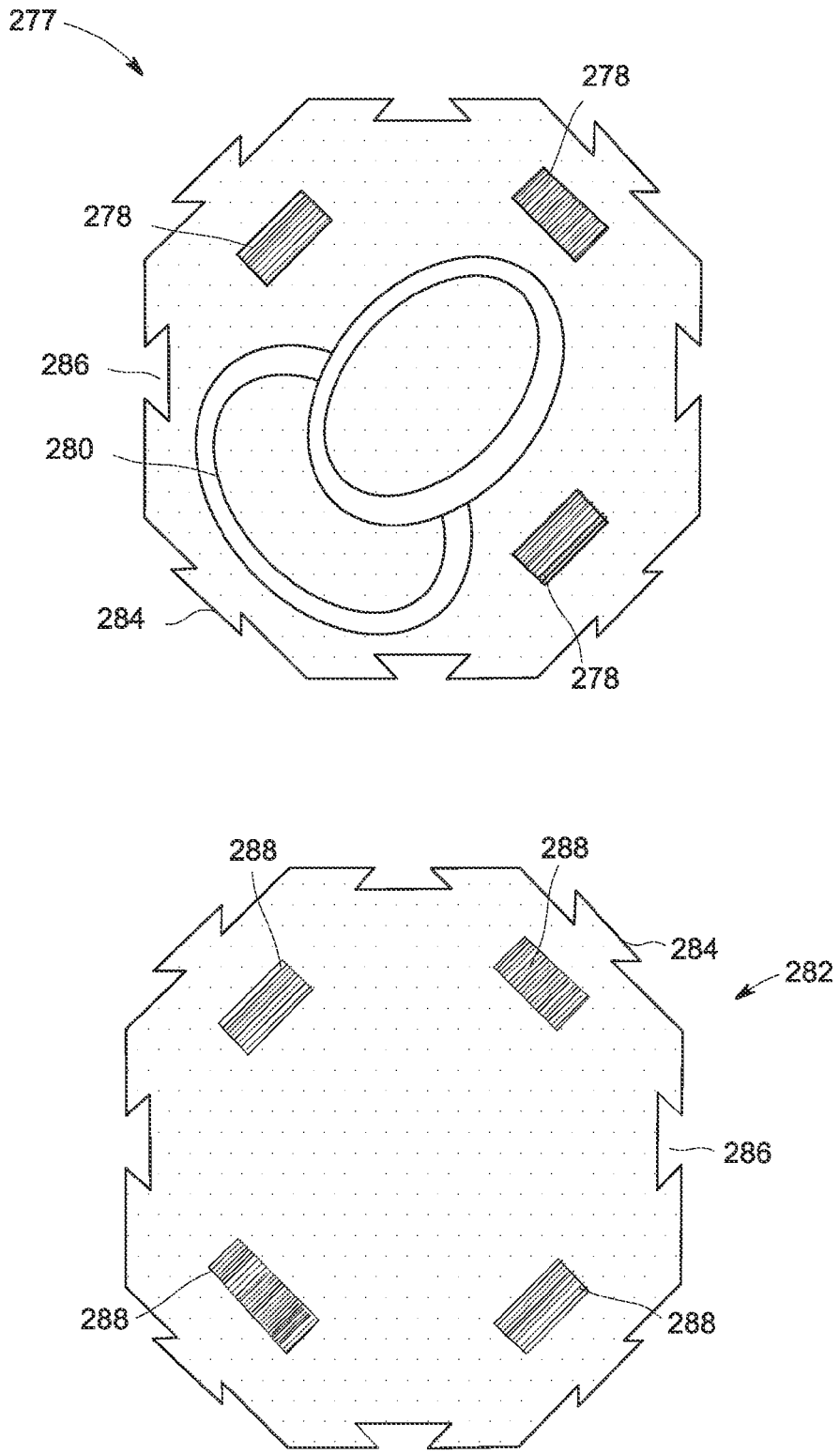
FIG. 34 illustrates the octagonal modular interlocking container of FIG. 33 with alternative connectivity and a pop-top pour mechanism.

In other embodiments, an exemplary interconnected container 274 formed with flat top end 276 and a flat bottom-end with indentions is illustrated in FIG. 33 and in plan and bottom end views in FIG. 34. Container 274 is shown constructed with perpendicular walls in an octagonal arrangement; however, cylindrical or three or more walls forming the container 274 also fall within the scope of the embodiments. Protruding pegs 278 are used for vertical interconnection with other containers and are distributed in an arrangement on the top end and rise a distance away from top end 276. FIG. 34 illustrates a plan view 277 of container 274, formed as a 4-wedge 284 and 4-groove 286 octagonal container for side-to-side connectivity. Vertical connectivity is accomplished with connector pegs 278 mounted on top end 276 and corresponding peg-slot receptors 288 formed on bottom end 282 that can receive connector pegs 278 from another similarly constructed container. A "pop-top" mechanism 280 is formed into top-end 276 to allow a user to pull and create an access opening to container contents for pouring contents out of container 274.

Figure 35:
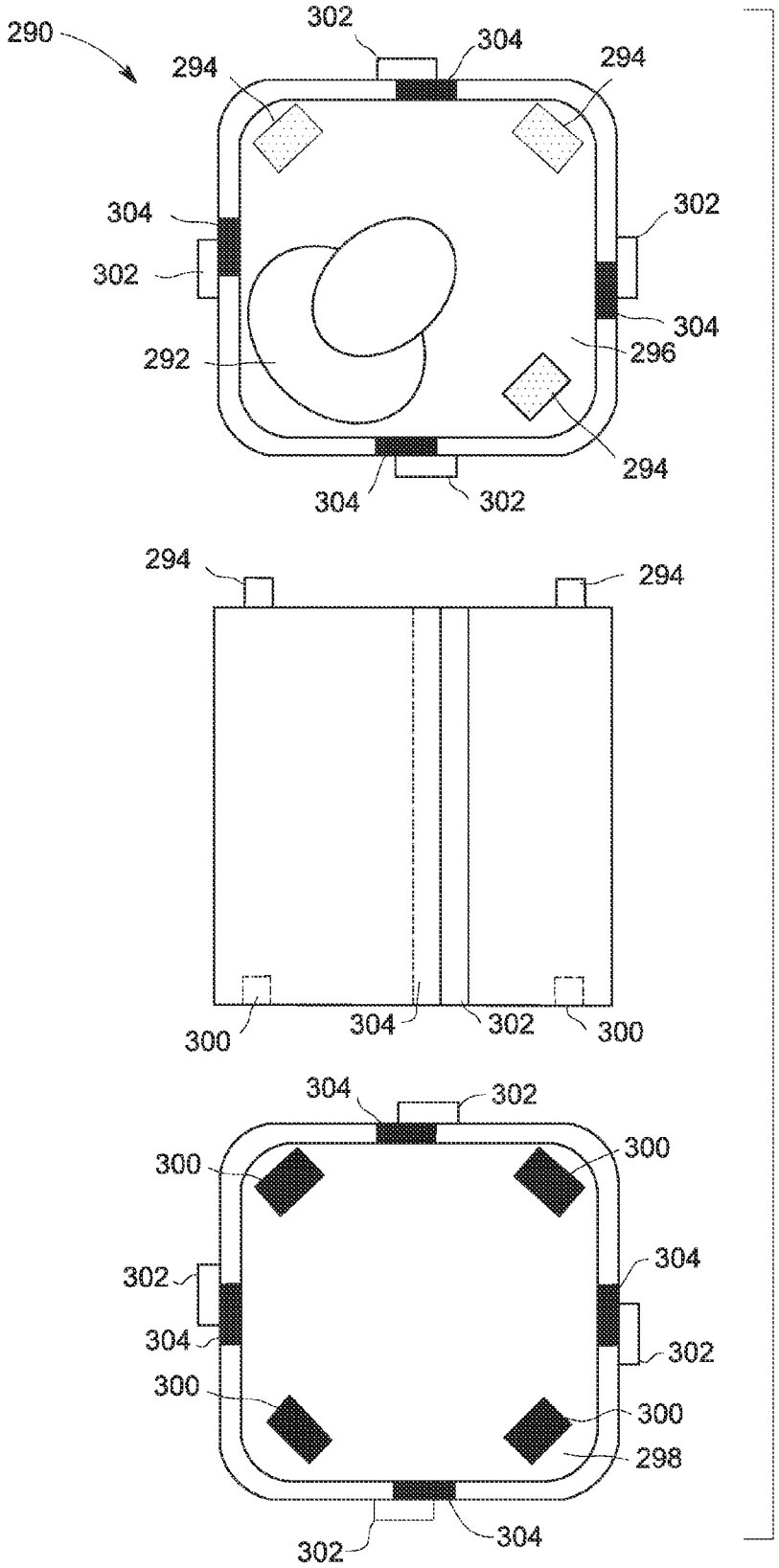
FIG. 35 illustrates other embodiments of a container with modular interconnectivity and a pop-top pour mechanism.

Referring to FIG. 35, in other embodiments a container 290 is formed with a "pop-top" opening mechanism 292 for pouring from a top end. Each embodiment provides top-to-bottom end connectivity via an arrangement of connector pegs 294 mounted on top end 296. Peg-slot receiving indentions 300 are formed in bottom end 298 to receive pegs similarly sized to pegs 294 from a second container in a stacked arrangement as illustrated in arrangement 306 in FIG. 36A. Container 290 may be constructed in a geometrical design with or without rounded corners, although the shape of the container 290 is not limited to such a design and could be cylindrical or other design. Horizontal interconnectivity is accomplished with the arrangement of connection wedges 302 mounted laterally down the side of container 290 and recessed grooves 304 formed in negative parallel to wedges 302.

Figure 36A:
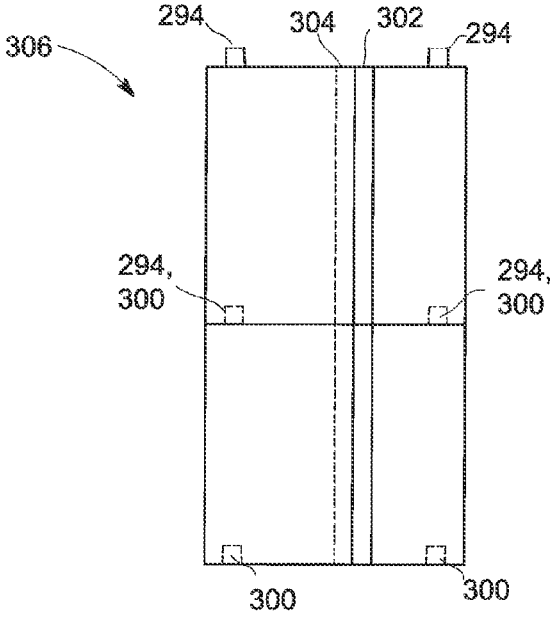
FIGS. 36A to 36C illustrate various volumetric sizes of the exemplary container of FIG. 35.
Figure 36C:
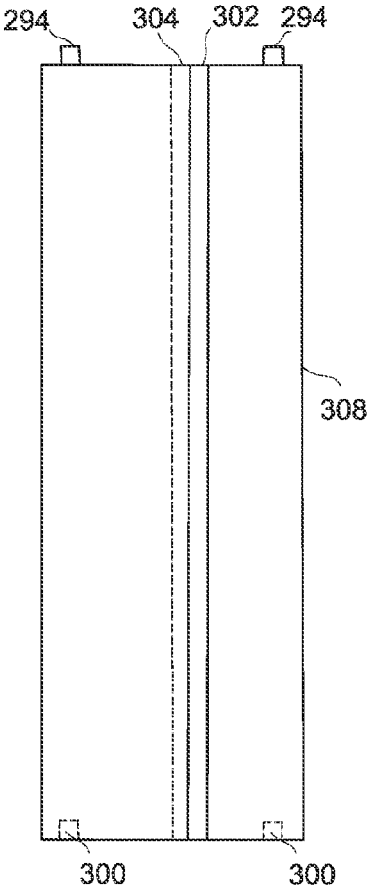
Figure 36B:
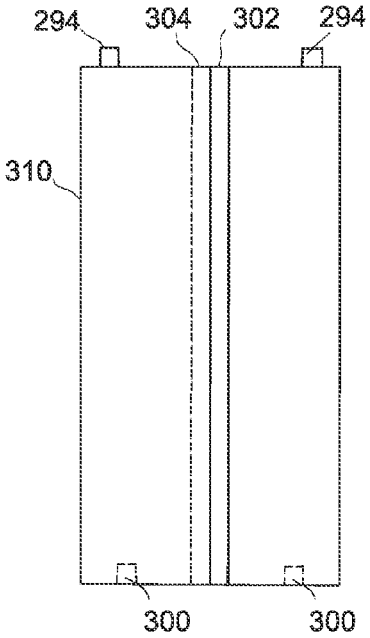

FIGS. 36A-C illustrates other embodiments scalable to varying volumetric sizes that retain the same connectivity and top-end and bottom-end features as container 290. For example container 310 is has a 500 mL volumetric capacity, while container 308 has a 750 mL volumetric capacity. Each container of varying volumetric size only extends laterally upwards thereby retaining their vertical and horizontal interconnectivity features. The essential container design reflected in the embodiments is amenable to any number of scalable, proportional volumetric capacities.

Figure 37:
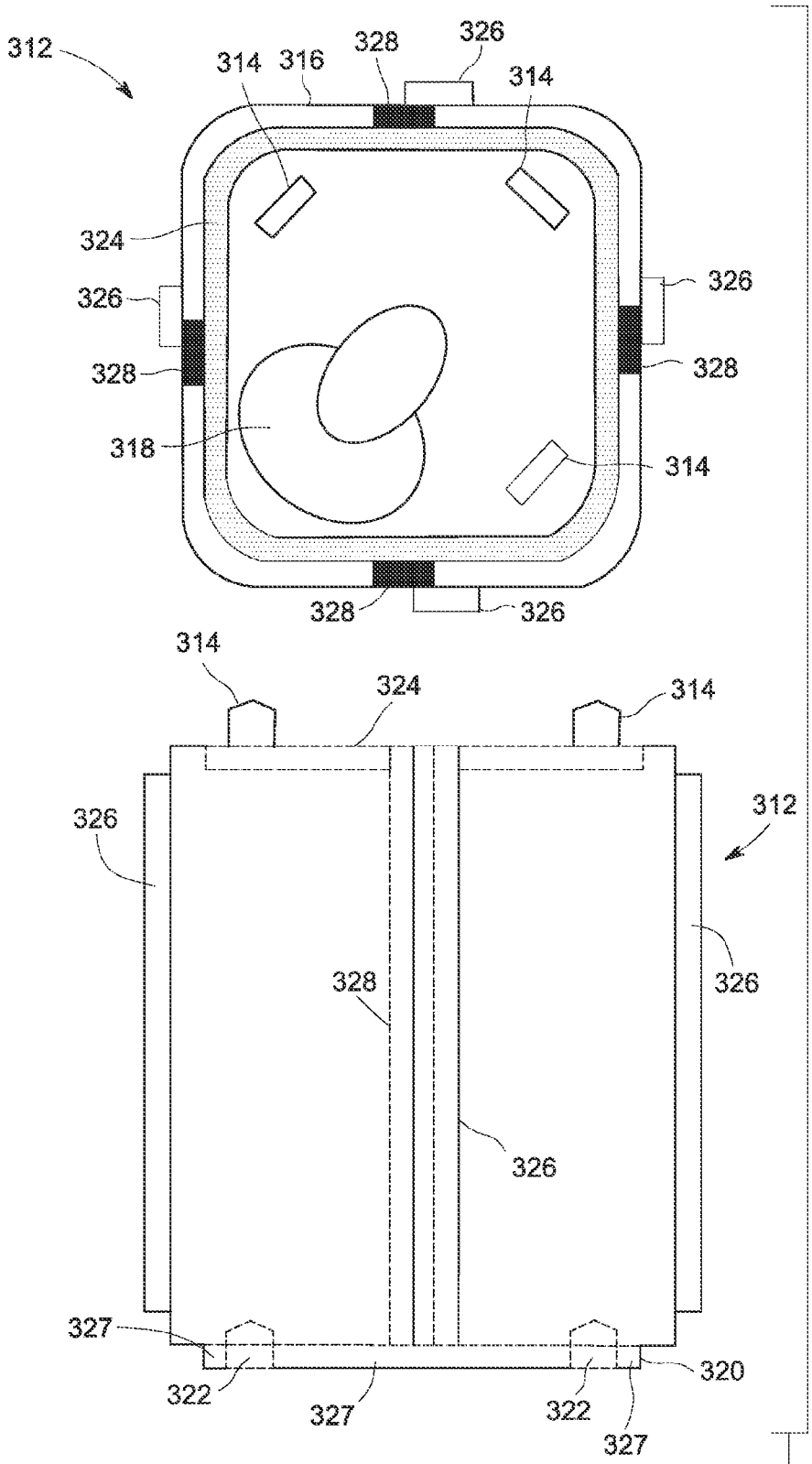
FIG. 37 illustrates further embodiments of a container with modular interconnectivity and a pop-top pour mechanism.
Figure 38:
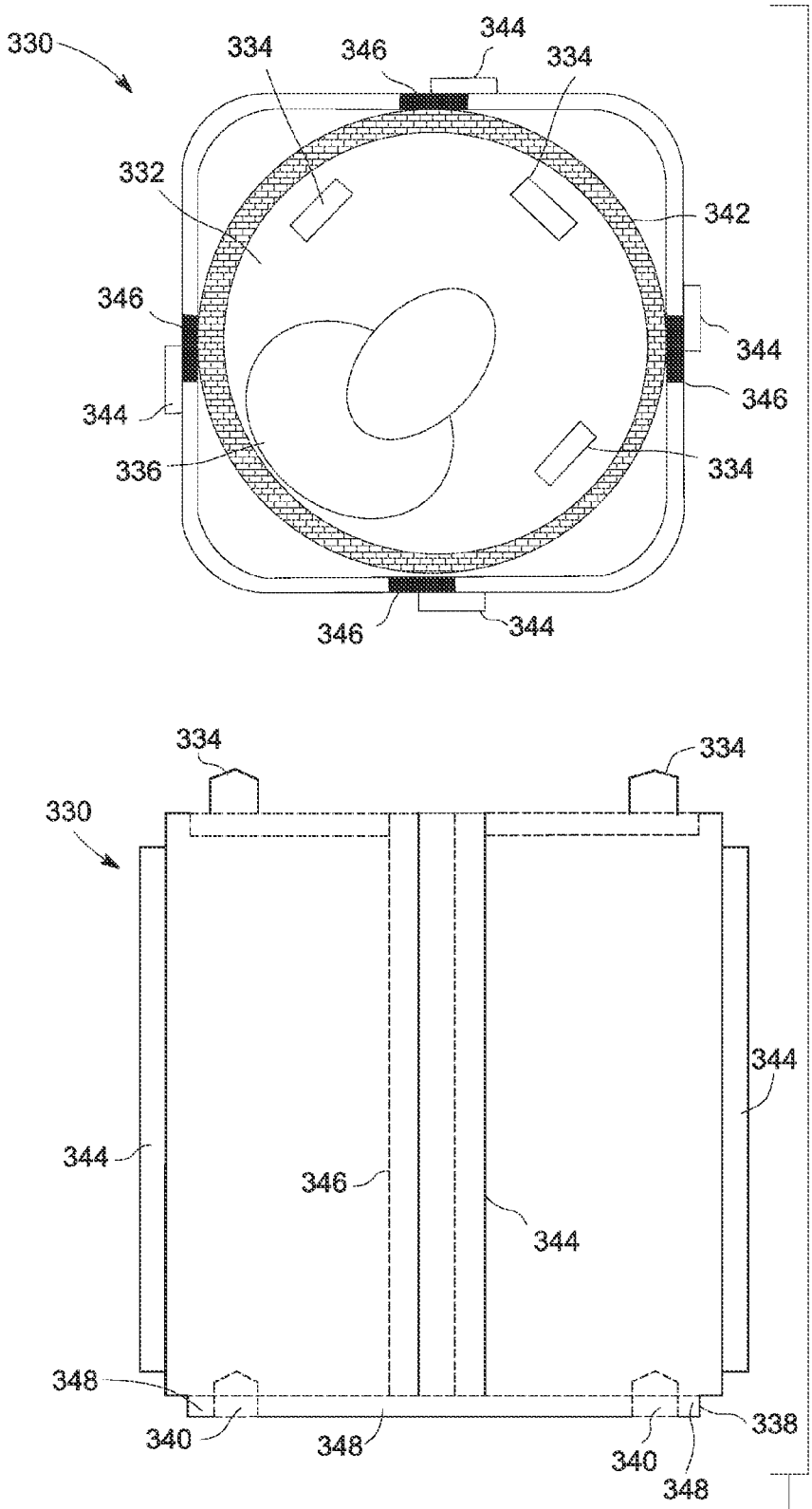
FIG. 38 illustrates further embodiments of a container with modular interconnectivity and a pop-top pour mechanism.

Referring to FIG. 37 and FIG. 38, other embodiments of a modular, scalable, interconnective container are illustrated. Container 312 is formed with a squared footprint having rounded corners; however, the scope of the embodiment for a container shape includes cylindrical and three or more sided containers and should be not limited by the illustrated example. Top end 316 comprises vertical connection pegs 314 that are mounted around a "pop-top" opener 318. On a bottom end 320, peg-slots 322 are arranged to receive pegs sized and formed similar to pegs 314 from a second container in vertical alignment in order to facilitate vertical stacking arrangements of multiple containers. Top end 316 further includes a ridge 324 that is set apart from and parallels the edge of the container. Ridge 324 is raised slightly above top-end surface 316. A corresponding horizontally formed recessed groove 327 is located in the bottom end 320 that is aligned to receive a raised ridge similar to ridge 324 mounted on a top end of another container in order to facilitate an interlocking mechanism for vertical stacking arrangement of multiple containers. Horizontal interconnectivity is accomplished with the arrangement of connection wedges 326 mounted laterally down a side of container 312 and recessed grooves 328 formed in negative parallel to wedges 326.

Referring to FIG. 38, in other embodiments an exemplary container 330 is formed with a squared footprint having rounded corners. However, the embodiment is not limited to a particular cross-sectional shape and could be cylindrical or formed with three or more sides. Top end 332 includes vertical connection pegs 334 that are arranged around a "pop-top" opener 336. On a bottom end 338 peg-slot indentions 340 are arranged to receive pegs from another container that correspond to pegs 334 in order to facilitate vertical stacking arrangements of multiple containers. Top end 332 further includes a ridge 342 that is formed in an exemplary circular pattern within the outer edge of top end 332. Ridge 342 is slightly raised above top-end surface 332. A corresponding horizontally recessed groove 348 is formed in the bottom end 338 and is aligned to receive a ridge from another container that corresponds to ridge 342 in order to facilitate a stacking arrangement of multiple containers. Horizontal interconnectivity is accomplished with the arrangement of connection wedges 344 mounted laterally down a side of container 330 and corresponding recessed grooves 346 formed in negative parallel to wedges 344.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed:

1. A modular interlocking container, comprising:

a top end section comprising an opening formed by a neck protruding from a top end surface of the top end section, wherein the top end surface is formed at a rising angle from outer edges of the top end section and converging around the neck;

a bottom end section comprising an indention formed in a bottom end surface shaped to receive a second top end section protruding neck formed on a second container, wherein the bottom end surface is formed at a rising angle corresponding to the top end surface rising angle, from outer edges of the bottom end section and converging around the indention;

a plurality of lateral walls, wherein each lateral edge of a lateral wall connects to a lateral edge of an adjacent lateral wall, thereby forming a walled unit having a polygonal cross-section, wherein the top end section connects securely to a first end of the walled unit, and the bottom end section connects securely to a second end of the walled unit, thereby forming a container;

a handle, with undercuts, laterally connected to a first lateral wall of the container such that a portion of the handle is disposed across a concave-shaped space in the first lateral wall, wherein a perimeter of the concaved-shaped space is inset from each lateral edge of the first lateral wall; and a recessed groove formed laterally within a second lateral wall of the container, wherein the groove is shaped to slidably receive, in an interlocking manner, a second handle formed with undercuts on a second container.

2. The container of claim 1, wherein the walled unit comprises four walls, wherein the top end and bottom end surfaces rise in a pyramidal shape, and wherein a third wall and a fourth wall each further comprise a recessed groove formed laterally along the third and fourth walls that can each slidably receive, in an interlocking manner, a second handle formed on a second container.

3. The container of claim 1, further comprising a first notch formed at a base of one of the walls, providing an empty pocket within such wall of the container.

4. The container of claim 1, wherein the first lateral wall of the plurality of lateral walls further comprises a second handle attached in parallel with the handle, and the second lateral wall of the plurality of lateral walls further comprises a second recessed groove formed in parallel with the recessed groove.

5. A modular interlocking container, comprising:

a top end section comprising an opening formed by a neck protruding from a top end surface of the top end section, wherein the top end surface is formed to extend at an angle from outer edges of the top end section and converge around the neck;

a bottom end section comprising an indention formed in a bottom end surface shaped to receive a second top end protruding neck formed on a second container, wherein the bottom end surface is formed to extend at an angle from outer edges of the bottom end section to converge around the indention;

a plurality of lateral walls, wherein each lateral edge of a wall connects to a lateral edge of an adjacent wall, thereby forming a walled unit having a polygonal cross-section, wherein the top end section connects securely to a first end of the walled unit, and the bottom end section connects securely to a second end of the walled unit, thereby forming a container;

a connection tongue, formed as a handle with undercuts, connected to a first wall, such that a portion of the handle is disposed across a concave-shaped space in the first wall, wherein a perimeter of the concaved-shaped space is inset from each lateral edge of the first wall;

a recessed groove formed laterally within a second wall of the container, wherein the recessed groove is shaped to slidably receive, in an interlocking manner, a second connection tongue formed with undercuts on a second container; and a channel formed beginning at a bottom end of the recessed groove, along a surface of the bottom end section, to the indention.

6. The modular interlocking container of claim 5, wherein the channel bisects a bottom end of the second wall.

7. The modular interlocking container of claim 5, further comprising:

a ridge, formed along the top end surface of the top end section, and also formed such that the ridge could be received by a second channel on a bottom surface of a second container.

8. The modular interlocking container of claim 7, wherein the ridge bisects the top end of one of the walls.

9. A modular interlocking container, comprising:

a top end section comprising an opening formed by a neck protruding from a top end surface of the top end section;

a bottom end section comprising an indention formed in a bottom end surface that is shaped to receive a second top end neck formed on a second container, a closed wall section comprising a top end and a bottom end, wherein the top end section connects securely to the top end of the closed wall section, and the bottom end section connects securely to the bottom end of the closed wall section, thereby forming a container;

a handle, formed with undercuts, laterally connected to the closed wall section such that a portion of the handle is disposed across a concave-shaped space in the closed wall section, wherein a perimeter of the concaved-shaped space is inset from each lateral edge of the closed wall section; and a recessed groove, formed in the closed wall section, wherein the groove is shaped to slidably receive, in an interlocking manner, a second handle formed with undercuts on a second container.

10. An assembly, comprising:

a plurality of modular interlocking containers, each container comprising:

a top end section comprising an opening formed by a neck protruding from a surface of the top end section, wherein a top end surface is formed at a corresponding angle from outer edges of the top end section and converging around the neck;

a bottom end section comprising an indention formed in a bottom end surface shaped to receive a second top end protruding neck formed on a second container, wherein the bottom end surface is formed to extend at an angle from outer edges of the bottom end section to converge around the indention;

a plurality of lateral walls, wherein each lateral edge of a wall connects to a lateral edge of an adjacent wall, thereby forming a walled unit having a polygonal cross-section, wherein the top end section connects securely to a first end of the walled unit, and the bottom end section connects securely to a second end of the walled unit, thereby forming a container;

a handle, with undercuts, laterally connected to a first wall of the container such that a portion of the handle is disposed across a concave-shaped space in the first wall, wherein a perimeter of the concaved-shaped space is inset from each lateral edge of the first wall; and a recessed groove formed laterally within a second wall of the container, wherein the recessed groove slidably receives, in an interlocking manner, a second handle formed with undercuts on a second container of the plurality of modular interlocking containers.

11. The assembly of claim 10, wherein the plurality of modular interlocking containers are stacked vertically on one another, thereby creating an interconnected structure.

12. The assembly of claim 10, wherein the plurality of modular interlocking containers form various volumetric capacities while maintaining an identical depth in their own footprint, and wherein each of the remaining plurality of modular interlocking containers of various capacities can maintain interconnection vertically and horizontally with any of the other adjacent modular interlocking containers of various capacities of which the plurality modular interlocking is comprised.

13. The assembly of claim 10, further comprising:

on each of the plurality of modular interlocking containers, a second handle attached in parallel with the handle on the first wall; and on each of the plurality of modular interlocking containers, the second wall comprises a second recessed groove formed in parallel with the recessed groove, wherein the plurality of modular interlocking containers are slidably interconnected using the handles inserted into one or more grooves of an adjacent modular interlocking container or plurality of modular interlocking containers.

* * * * *